US011654681B2

(12) United States Patent
Naganuma et al.

(10) Patent No.: US 11,654,681 B2
(45) Date of Patent: May 23, 2023

(54) LIQUID EJECTING HEAD AND LIQUID EJECTING APPARATUS

(71) Applicant: SEIKO EPSON CORPORATION, Tokyo (JP)

(72) Inventors: Yoichi Naganuma, Matsumoto (JP); Yuma Fukuzawa, Matsumoto (JP); Shotaro Tamai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 29 days.

(21) Appl. No.: 17/159,236

(22) Filed: Jan. 27, 2021

(65) Prior Publication Data

US 2021/0237442 A1 Aug. 5, 2021

(30) Foreign Application Priority Data

Jan. 30, 2020 (JP) ..... JP2020-013350

(51) Int. Cl.

*B41J 2/14* (2006.01)
*B41J 2/18* (2006.01)
*B41J 2/19* (2006.01)

(52) U.S. Cl.

CPC ..... *B41J 2/14233* (2013.01); *B41J 2/18* (2013.01); *B41J 2/19* (2013.01); *B41J 2202/07* (2013.01); *B41J 2202/11* (2013.01); *B41J 2202/12* (2013.01)

(58) Field of Classification Search

CPC ..... B41J 2202/12
See application file for complete search history.

(56) References Cited

U.S. PATENT DOCUMENTS

| | | | | |
|---|---|---|---|---|
| 4,104,645 | A | 8/1978 | Fischbeck | |
| 11,123,985 | B2 * | 9/2021 | Mizuno | B41J 2/1433 |
| 2012/0092417 | A1 * | 4/2012 | Kumagai | B41J 2/18 347/85 |
| 2016/0221338 | A1 * | 8/2016 | Tomimatsu | B41J 2/14274 |
| 2017/0001442 | A1 | 1/2017 | Takabe et al. | |
| 2017/0106663 | A1 * | 4/2017 | Irokawa | B41J 2/1433 |
| 2018/0201019 | A1 * | 7/2018 | Seto | B41J 2/14233 |

(Continued)

FOREIGN PATENT DOCUMENTS

| | | | |
|---|---|---|---|
| JP | 2017-013390 A | | 1/2017 |
| JP | 2017209821 A | * | 11/2017 |

OTHER PUBLICATIONS

Machine generated English translation of JP2017209821A to Ikuta et al., "Liquid Discharge Head, Liquid Discharge Unit and Device for Discharging Liquid"; translation retreived via FIT database on Aug. 30, 2022.*

*Primary Examiner* — Shelby L Fidler
(74) *Attorney, Agent, or Firm* — Workman Nydegger

(57) ABSTRACT

Wall surfaces of the nozzle channel include a first wall surface which extends in the first direction and in which the nozzle is provided and a second wall surface which extends in the first direction and is opposite to the first wall surface, wall surfaces of the first communication channel include a third wall surface which extends in the second direction and a distance from which to the nozzle in the first direction is longest and a fourth wall surface which extends in the second direction and is opposite to the third wall surface, and a fifth wall surface which extends in a third direction set between the first direction and the second direction is provided between the second wall surface and the fourth wall surface.

13 Claims, 16 Drawing Sheets

(56) References Cited

U.S. PATENT DOCUMENTS

| | | | | |
|---|---|---|---|---|
| 2019/0084305 | A1* | 3/2019 | Sugiura | B41J 2/14209 |
| 2019/0143680 | A1* | 5/2019 | Yamamura | B41J 2/1433<br>347/47 |
| 2019/0299609 | A1* | 10/2019 | Sugiura | B41J 2/14209 |
| 2019/0299615 | A1* | 10/2019 | Sugiura | B41J 2/14274 |
| 2019/0366717 | A1* | 12/2019 | Tsukahara | B41J 2/175 |
| 2020/0198343 | A1* | 6/2020 | Fukuzawa | B41J 2/0459 |
| 2021/0016567 | A1* | 1/2021 | Takeuchi | B41J 2/14 |

* cited by examiner

LIQUID EJECTING HEAD AND LIQUID EJECTING APPARATUS

The present application is based on, and claims priority from JP Application Serial Number 2020-013350, filed Jan. 30, 2020, the disclosure of which is hereby incorporated by reference herein in its entirety.

BACKGROUND

1. Technical Field

The present disclosure relates to a liquid ejecting head and a liquid ejecting apparatus.

2. Related Art

As described in JP-A-2017-013390, techniques of a liquid ejecting head that ejects liquid in a pressure chamber from a nozzle have been known in the related art.

According to the techniques in the related art, however, there is a possibility that air bubbles remain in a channel that extends from the pressure chamber to the nozzle and that an ejection abnormality that makes it difficult for liquid to be ejected from the nozzle occurs.

SUMMARY

To cope with the aforementioned problem, a liquid ejecting head according to a suitable aspect of the disclosure includes: a first pressure chamber that extends in a first direction and applies pressure to a liquid; a second pressure chamber that extends in the first direction and applies pressure to the liquid; a nozzle channel that extends in the first direction and communicates with a nozzle for ejecting the liquid; a first communication channel that extends in a second direction crossing the first direction and causes the first pressure chamber to communicate with the nozzle channel; and a second communication channel that extends in the second direction and causes the second pressure chamber to communicate with the nozzle channel, in which wall surfaces of the nozzle channel include a first wall surface which extends in the first direction and in which the nozzle is provided and a second wall surface which extends in the first direction and is opposite to the first wall surface, wall surfaces of the first communication channel include a third wall surface which extends in the second direction and a distance from which to the nozzle in the first direction is longest and a fourth wall surface which extends in the second direction and is opposite to the third wall surface, and a fifth wall surface which extends in a third direction set between the first direction and the second direction is provided between the second wall surface and the fourth wall surface.

A liquid ejecting apparatus according to a suitable aspect of the disclosure includes: a first pressure chamber that extends in a first direction and applies pressure to a liquid; a second pressure chamber that extends in the first direction and applies pressure to the liquid; a nozzle channel that extends in the first direction and communicates with a nozzle for ejecting the liquid; a first communication channel that extends in a second direction crossing the first direction and causes the first pressure chamber to communicate with the nozzle channel; and a second communication channel that extends in the second direction and causes the second pressure chamber to communicate with the nozzle channel, in which wall surfaces of the nozzle channel include a first wall surface which extends in the first direction and in which the nozzle is provided and a second wall surface which extends in the first direction and is opposite to the first wall surface, wall surfaces of the first communication channel include a third wall surface which extends in the second direction and a distance from which to the nozzle in the first direction is longest and a fourth wall surface which extends in the second direction and is opposite to the third wall surface, and a fifth wall surface which extends in a third direction set between the first direction and the second direction is provided between the second wall surface and the fourth wall surface.

DESCRIPTION OF EXEMPLARY EMBODIMENTS

Figure 1:
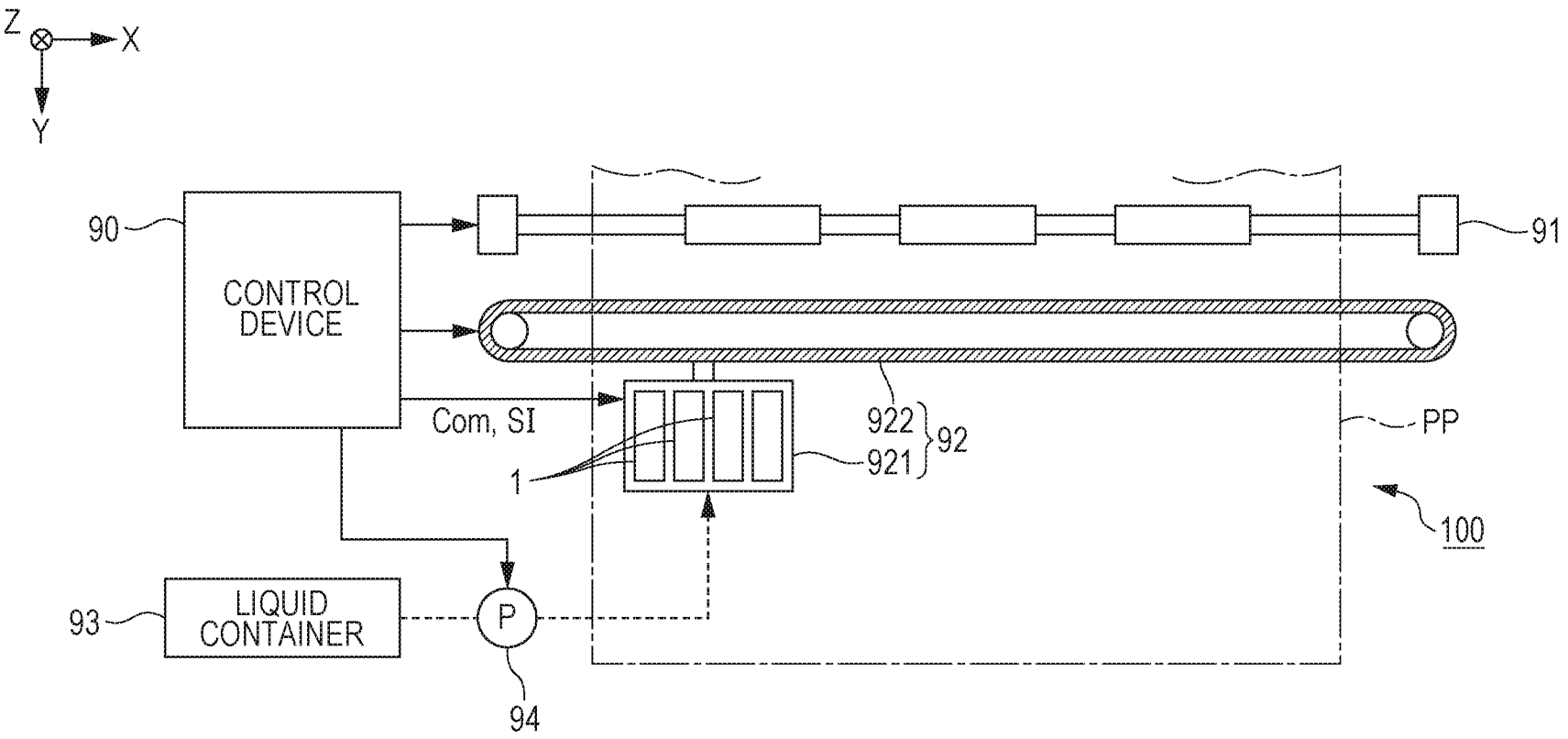
FIG. 1 is a configuration diagram illustrating an example of a liquid ejecting apparatus according to an embodiment of the disclosure.

An embodiment of the disclosure will be described below with reference to the drawings. Note that, in the drawings, dimensions and scales of components appropriately differ from actual ones. Since the embodiment described below is a preferred specific example of the disclosure, various limitations that are desirable from a technical viewpoint are added. However, the scope of the disclosure is not limited to the embodiment as long as there is no description particularly limiting the disclosure in the following description.

A. Embodiment

A liquid ejecting apparatus 100 according to the present embodiment will be described below with reference to FIG. 1.

1. Outline of Liquid Ejecting Apparatus

FIG. 1 is a view for explaining an example of the liquid ejecting apparatus 100 according to the present embodiment. The liquid ejecting apparatus 100 according to the present embodiment is an ink jet printing apparatus that ejects ink onto a medium PP. Although the medium PP is typically a printing sheet, any printing object made from a resin film, fabric, or the like can be used as the medium PP.

As illustrated in FIG. 1, the liquid ejecting apparatus 100 includes a liquid container 93 that accumulates ink. As the liquid container 93, for example, a cartridge detachably attachable to the liquid ejecting apparatus 100, a bag-like ink pack formed from a flexible film, or an ink tank that is able to be replenished with ink is able to be adopted. The liquid container 93 accumulates a plurality of types of inks of different colors.

As illustrated in FIG. 1, the liquid ejecting apparatus 100 includes a control device 90, a moving mechanism 91, a transport mechanism 92, and a circulation mechanism 94.

Among these, the control device 90 includes, for example, a processing circuit such as a CPU or FPGA and a storage circuit such as semiconductor memory and controls respective elements of the liquid ejecting apparatus 100. Here, "CPU" is an abbreviation for central processing unit and "FPGA" is an abbreviation for field programmable gate array.

The moving mechanism 91 transports the medium PP in the +Y direction in accordance with control of the control device 90. Note that, in the following description, the +Y direction and the −Y direction, which is opposite to the +Y direction, are collectively referred to as the Y-axis direction.

The transport mechanism 92 causes a plurality of liquid ejecting heads 1 to reciprocate in the +X direction and the −X direction, which is opposite to the +X direction, in accordance with control of the control device 90. Note that, in the following description, the +X direction and the −X direction are collectively referred to as the X-axis direction. Here, the +X direction is a direction crossing the +Y direction. The +X direction is typically a direction orthogonal to the +Y direction. The transport mechanism 92 includes a storage case 921 that stores the plurality of liquid ejecting heads 1 and an endless belt 922 to which the storage case 921 is fixed. Note that the liquid container 93 may be stored in the storage case 921 together with the liquid ejecting heads 1.

The circulation mechanism 94 supplies the ink, which is accumulated in the liquid container 93, to a supply channel RB1 provided in a liquid ejecting head 1 in accordance with control of the control device 90. Further, in accordance with control of the control device 90, the circulation mechanism 94 collects ink accumulated in a discharge channel RB2 provided in the liquid ejecting head 1 and causes the collected ink to return to the supply channel RB1. Note that the supply channel RB1 and the discharge channel RB2 will be described later with reference to FIG. 3.

As illustrated in FIG. 1, a driving signal Com for driving the liquid ejecting head 1 and a control signal SI for controlling the liquid ejecting head 1 are supplied from the control device 90 to the liquid ejecting head 1. Then, in accordance with control with the control signal SI, the liquid ejecting head 1 is driven with the driving signal Com to eject the ink in the +Z direction from a portion of or all M nozzles N provided in the liquid ejecting head 1. Here, a value of M is a natural number of 1 or more. The +Z direction is a direction crossing the +X direction and the +Y direction. The +Z direction is typically a direction orthogonal to the +X direction and the +Y direction. In the following description, the +Z direction and the −Z direction, which is opposite to the +Z direction, are collectively referred to as the Z-axis direction in some cases. Note that the nozzles N will be described later with reference to FIGS. 2 and 3.

In conjunction with transport of the medium PP by the moving mechanism 91 and reciprocation of the liquid ejecting head 1 by the transport mechanism 92, the liquid ejecting head 1 ejects the ink from a portion of or all the M nozzles N and causes the ejected ink to be deposited on the surface of the medium PP to thereby form a desired image on the surface of the medium PP.

2. Outline of Liquid Ejecting Head

An outline of the liquid ejecting head 1 will be described below with reference to FIGS. 2 to 4.

Figure 2:
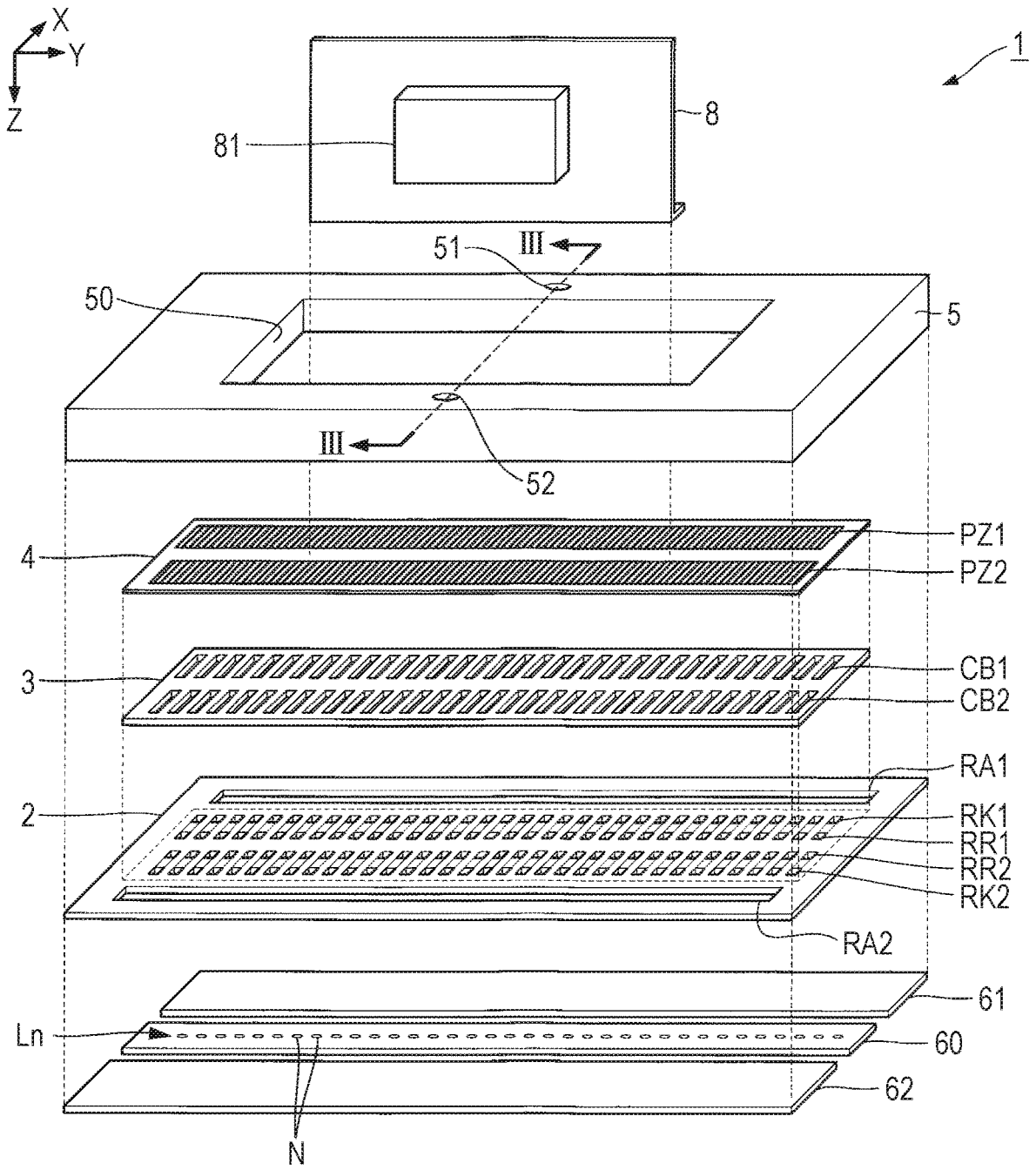
FIG. 2 is an exploded perspective view illustrating an example of a configuration of a liquid ejecting head.
Figure 3:
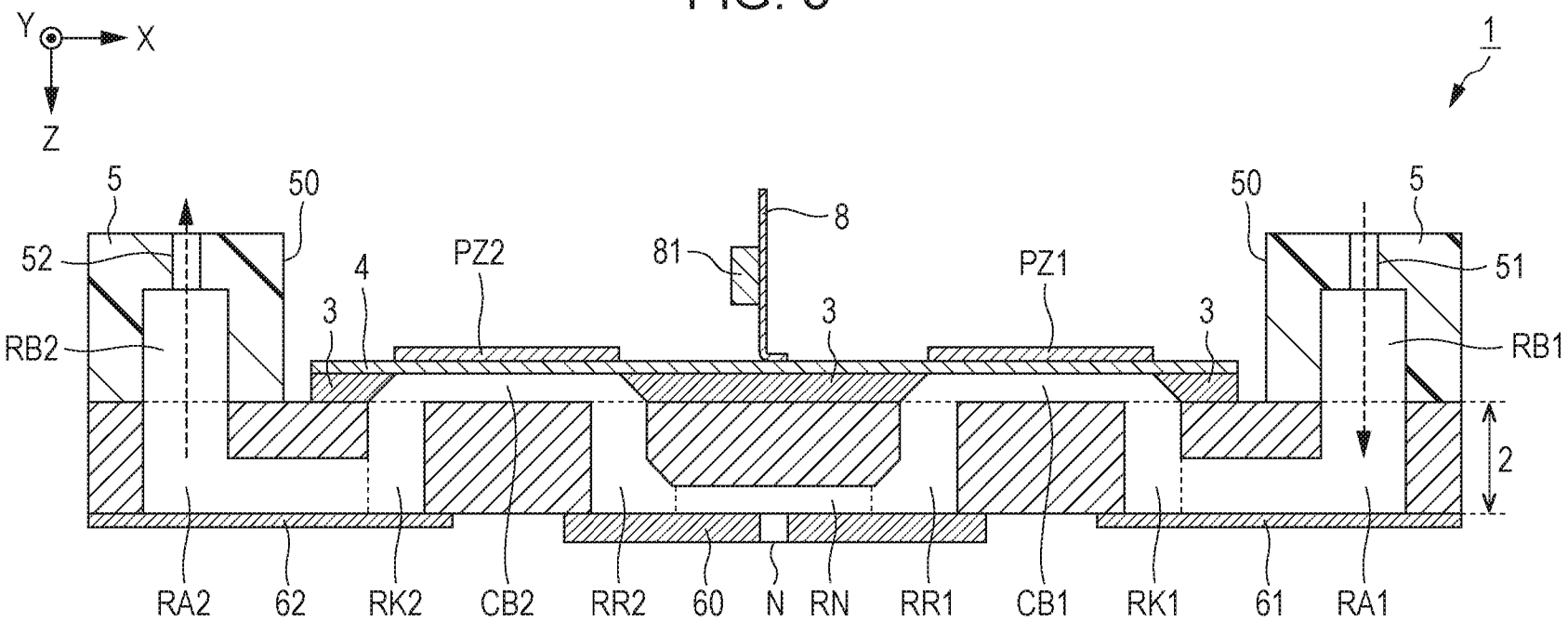
FIG. 3 is a sectional view illustrating an example of the configuration of the liquid ejecting head.

Note that FIG. 2 is an exploded perspective view of the liquid ejecting head 1, and FIG. 3 is a sectional view along line III-III in FIG. 2.

As illustrated in FIGS. 2 and 3, the liquid ejecting head 1 includes a nozzle substrate 60, a compliance sheet 61, a compliance sheet 62, a communication plate 2, a pressure chamber substrate 3, a vibrating plate 4, an accumulation chamber forming substrate 5, and a wiring substrate 8.

As illustrated in FIG. 2, the nozzle substrate 60 is a plate member, which is elongated in the Y-axis direction and extends substantially parallel to the XY plane, and has the M nozzles N formed therein. Here, the term "substantially parallel" includes not only a case of being exactly parallel but also a case of being regarded as parallel within a tolerance. The nozzle substrate 60 is manufactured, for example, in such a manner that a silicon monocrystalline substrate is processed by using a semiconductor manufacturing technique such as etching. Note that any known material and process can be adopted to manufacture the nozzle substrate 60. The nozzles N are through holes provided in the nozzle substrate 60. In the present embodiment, for example, a case where the M nozzles N are provided in the nozzle substrate 60 so as to form a nozzle row Ln that extends in the Y-axis direction is assumed.

As illustrated in FIGS. 2 and 3, the communication plate 2 is provided on the −Z side of the nozzle substrate 60. The communication plate 2 is a plate member, which is elongated in the Y-axis direction and extends substantially parallel to the XY plane, and has an ink channel formed therein.

Specifically, one supply channel RA1 and one discharge channel RA2 are formed in the communication plate 2. Of the supply channel RA1 and the discharge channel RA2, the supply channel RA1 communicates with the supply channel RB1 described later and is provided so as to extend in the Y-axis direction. The discharge channel RA2 communicates with the discharge channel RB2 described later and is provided, in the −X direction as viewed from the supply channel RA1, so as to extend in the Y-axis direction.

In the communication plate 2, M coupling channels RK1 corresponding on a one-to-one basis to the M nozzles N, M coupling channels RK2 corresponding on a one-to-one basis to the M nozzles N, M communication channels RR1 corresponding on a one-to-one basis to the M nozzles N, M communication channels RR2 corresponding on a one-to-one basis to the M nozzles N, and M nozzle channels RN corresponding on a one-to-one basis to the M nozzles N are formed. Among these, a coupling channel RK1 communicates with the supply channel RA1 and is provided, in the −X direction as viewed from the supply channel RA1, so as to extend in the Z-axis direction. A communication channel RR1 is provided, in the −X direction as viewed from the coupling channel RK1, so as to extend in the Z-axis direction. A coupling channel RK2 communicates with the discharge channel RA2 and is provided, in the +X direction as viewed from the discharge channel RA2, so as to extend in the Z-axis direction. A communication channel RR2 is provided, in the +X direction as viewed from the coupling channel RK2 and in the −X direction as viewed from the communication channel RR1, so as to extend in the Z axis direction. A nozzle channel RN communicates with the communication channel RR1 and the communication channel RR2 and is provided, in the −X direction as viewed from the communication channel RR1 and in the +X direction as viewed from the communication channel RR2, so as to extend in the X-axis direction. The nozzle channel RN communicates with a nozzle N corresponding to the nozzle channel RN.

Note that the communication plate 2 is manufactured, for example, in such a manner that a silicon monocrystalline substrate is processed by using a semiconductor manufacturing technique. Note that any known material and process can be adopted to manufacture the communication plate 2.

As illustrated in FIGS. 2 and 3, the pressure chamber substrate 3 is provided on the −Z side of the communication plate 2. The pressure chamber substrate 3 is a plate member, which is elongated in the Y-axis direction and extends substantially parallel to the XY plane, and has an ink channel formed therein.

Specifically, in the pressure chamber substrate 3, M pressure chambers CB1 corresponding on a one-to-one basis to the M nozzles N and M pressure chambers CB2 corresponding on a one-to-one basis to the M nozzles N are formed. Among these, a pressure chamber CB1 communicates with the coupling channel RK1 and the communication channel RR1 and is provided, as viewed in the Z-axis direction, so as to couple an end of the coupling channel RK1 on the +X side and an end of the communication channel RR1 on the −X side and extend in the X-axis direction. A pressure chamber CB2 communicates with the coupling channel RK2 and the communication channel RR2 and is provided, as viewed in the Z-axis direction, so as to couple an end of the coupling channel RK2 on the −X side and an end of the communication channel RR2 on the +X side and extend in the X-axis direction.

Note that the pressure chamber substrate 3 is manufactured, for example, in such a manner that a silicon monocrystalline substrate is processed by using a semiconductor manufacturing technique. Note that any known material and process can be adopted to manufacture the pressure chamber substrate 3.

Note that, in the following description, an ink channel that causes the supply channel RA1 and the discharge channel RA2 to communicate with each other is referred to as a circulation channel RJ. That is, M circulation channels RJ corresponding on a one-to-one basis to the M nozzles N cause the supply channel RA1 and the discharge channel RA2 to communicate with each other. Each of the circulation channels RJ includes the coupling channel RK1 that communicates with the supply channel RA1, the pressure chamber CB1 that communicates with the coupling channel RK1, the communication channel RR1 that communicates with the pressure chamber CB1, the nozzle channel RN that communicates with the communication channel RR1, the communication channel RR2 that communicates with the nozzle channel RN, the pressure chamber CB2 that communicates with the communication channel RR2, and the coupling channel RK2 that causes the pressure chamber CB2 and the discharge channel RA2 to communicate with each other, as described above.

As illustrated in FIGS. 2 and 3, the vibrating plate 4 is provided on the −Z side of the pressure chamber substrate 3. The vibrating plate 4 is a plate member, which is elongated in the Y-axis direction and extends substantially parallel to the XY plane, and is a member capable of elastically vibrating.

As illustrated in FIGS. 2 and 3, M piezoelectric elements PZ1 corresponding on a one-to-one basis to the M pressure chambers CB1 and M piezoelectric elements PZ2 corresponding on a one-to-one basis to the M pressure chambers CB2 are provided on the −Z side of the vibrating plate 4. In the following description, a piezoelectric element PZ1 and a piezoelectric element PZ2 are collectively referred to as a piezoelectric element PZq. The piezoelectric element PZq is a passive element that is deformed in accordance with a change in the potential of the driving signal Com. In other words, the piezoelectric element PZq is an example of an energy conversion element that converts electrical energy of the driving signal Com into kinetic energy. Note that, in the following description, components and signals of the liquid ejecting head 1, which correspond to the piezoelectric element PZq, are sometimes suffixed with "q".

Figure 4:
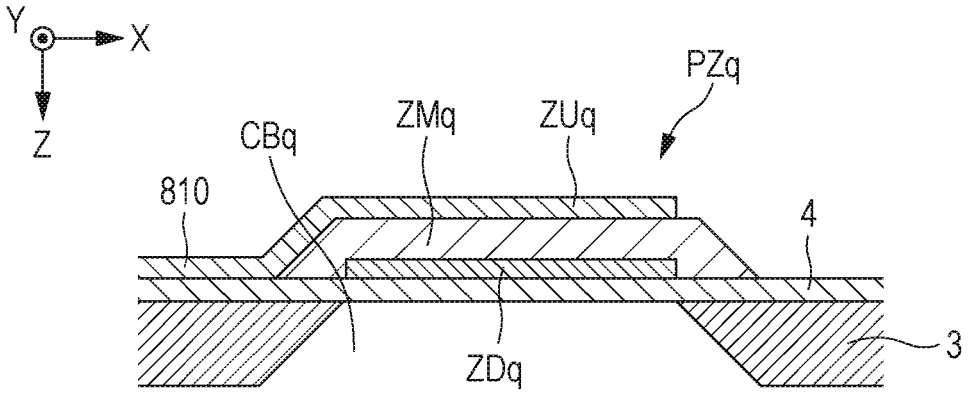
FIG. 4 is a sectional view illustrating an example of a configuration of a piezoelectric element.

FIG. 4 is an enlarged sectional view of the vicinity of the piezoelectric element PZq.

As illustrated in FIG. 4, the piezoelectric element PZq is a layered structure in which a piezoelectric material ZMq is interposed between a lower electrode ZDq to which a given reference potential VBS is supplied and an upper electrode ZUq to which the driving signal Com is supplied. The piezoelectric element PZq is, for example, a portion in which the lower electrode ZDq, the upper electrode ZUq, and the piezoelectric material ZMq overlap each other as viewed in the −Z direction. Moreover, a pressure chamber CBq is provided in the +Z direction of the piezoelectric element PZq.

As described above, the piezoelectric element PZq is driven and deformed in accordance with the change in the potential of the driving signal Com. The vibrating plate 4 vibrates with the deformation of the piezoelectric element PZq. When the vibrating plate 4 vibrates, the pressure in the pressure chamber CBq changes. The change in the pressure in the pressure chamber CBq causes the ink filled in the pressure chamber CBq to be ejected from the nozzle N via a communication channel RRq and the nozzle channel RN.

As illustrated in FIGS. 2 and 3, the wiring substrate 8 is mounted on the surface of the vibrating plate 4 on the −Z side. The wiring substrate 8 is a part for electrically coupling the control device 90 and the liquid ejecting head 1. As the wiring substrate 8, for example, a flexible wiring substrate such as an FPC or FFC is suitably adopted. Here, "FPC" is an abbreviation for flexible printed circuit, and "FFC" is an abbreviation for flexible flat cable. A drive circuit 81 is mounted on the wiring substrate 8. The drive circuit 81 is an electrical circuit that switches between supplying and not supplying the driving signal Com to the piezoelectric element PZq in accordance with control with the control signal SI. As illustrated in FIG. 4, the drive circuit 81 supplies the driving signal Com to the upper electrode ZUq of the piezoelectric element PZq via a wire 810.

Note that, in the following description, the driving signal Com supplied to the piezoelectric element PZ1 is sometimes referred to as a driving signal Com1, and the driving signal Com supplied to the piezoelectric element PZ2 is sometime referred to as a driving signal Com2. In the present embodiment, a case in which a waveform of the driving signal Com1 supplied from the drive circuit 81 to the piezoelectric element PZ1 corresponding to the nozzle N and a waveform of the driving signal Com2 supplied from the drive circuit 81 to the piezoelectric element PZ2 corresponding to the nozzle N are substantially identical when the ink is ejected from the nozzle N is assumed. Here, the term "substantially identical" includes not only a case of being exactly identical but also a case of being regarded as identical within a tolerance.

As illustrated in FIGS. 2 and 3, the accumulation chamber forming substrate 5 is provided on the −Z side of the communication plate 2. The accumulation chamber forming substrate 5 is a member, which is elongated in the Y-axis direction, and has an ink channel formed therein.

Specifically, one supply channel RB1 and one discharge channel RB2 are formed in the accumulation chamber forming substrate 5. Of the supply channel RB1 and the discharge channel RB2, the supply channel RB1 communicates with the supply channel RA1 and is provided, in the −Z direction as viewed from the supply channel RA1, so as to extend in the Y-axis direction. The discharge channel RB2 communicates with the discharge channel RA2 and is provided, in the −Z direction as viewed from the discharge channel RA2 and in the −X direction as viewed from the supply channel RB1, so as to extend in the Y-axis direction.

Further, an inlet port 51 that communicates with the supply channel RB1 and a discharge port 52 that communicates with the discharge channel RB2 are provided in the accumulation chamber forming substrate 5. The ink is supplied from the liquid container 93 to the supply channel RB1 via the inlet port 51. The ink accumulated in the discharge channel RB2 is collected via the discharge port 52.

An opening 50 is provided in the accumulation chamber forming substrate 5. The pressure chamber substrate 3, the vibrating plate 4, and the wiring substrate 8 are provided inside the opening 50.

Note that the accumulation chamber forming substrate 5 is formed, for example, by injection molding of a resin material. Note that any known material and process can be adopted to manufacture the accumulation chamber forming substrate 5.

In the present embodiment, the ink supplied from the liquid container 93 to the inlet port 51 flows to the supply channel RA1 via the supply channel RB1. Then, a portion of the ink flowing into the supply channel RA1 flows into the pressure chamber CB1 via the coupling channel RK1. A portion of the ink flowing into the pressure chamber CB1 flows into the pressure chamber CB2 via the communication channel RR1, the nozzle channel RN, and the communication channel RR2. Then, a portion of the ink flowing into the pressure chamber CB2 is discharged from the discharge port 52 via the coupling channel RK2, the discharge channel RA2, and the discharge channel RB2.

Note that, when the piezoelectric element PZ1 is driven with the driving signal Com1, a portion of the ink filled in the pressure chamber CB1 is ejected from the nozzle N via the communication channel RR1 and the nozzle channel RN. When the piezoelectric element PZ2 is driven with the driving signal Com2, a portion of the ink filled in the pressure chamber CB2 is ejected from the nozzle N via the communication channel RR2 and the nozzle channel RN.

As illustrated in FIGS. 2 and 3, the compliance sheet 61 is provided on the surface of the communication plate 2 on the +Z side so as to block the supply channel RA1 and the coupling channel RK1. The compliance sheet 61 is formed of an elastic material and absorbs a change in the pressure of the ink in the supply channel RA1 and the coupling channel RK1. Additionally, the compliance sheet 62 is provided on the surface of the communication plate 2 on the +Z side so as to block the discharge channel RA2 and the coupling channel RK2. The compliance sheet 62 is formed of an elastic material and absorbs a change in the pressure of the ink in the discharge channel RA2 and the coupling channel RK2.

As described above, the liquid ejecting head 1 according to the present embodiment causes the ink to circulate from the supply channel RA1 to the discharge channel RA2 via the circulation channel RJ. Therefore, in the present embodiment, even when a period during which the ink in the pressure chamber CBq is not ejected from the nozzle N exists, it is possible to prevent the ink from continuously remaining in the pressure chamber CBq, the nozzle channel RN, or the like. Thus, in the present embodiment, even when a period during which the ink in the pressure chamber CBq is not ejected from the nozzle N exists, it is possible to avoid an increase in the viscosity of the ink in the pressure chamber CBq, thus making it possible to prevent an occurrence of an ejection abnormality that makes it difficult for the ink to be ejected from the nozzle N due to an increase in the viscosity of the ink.

Moreover, the liquid ejecting head 1 according to the present embodiment is able to eject, from the nozzle N, the ink filled in the pressure chamber CB1 and the ink filled in the pressure chamber CB2. Therefore, the liquid ejecting head 1 according to the present embodiment is able to increase the amount of the ink ejected from the nozzle N, for example, compared with an aspect in which ink filled in only one pressure chamber CBq is ejected from the nozzle N.

3. Shape of Circulation Channel

The shape of the circulation channel RJ will be described below with reference to FIGS. 5 and 6.

Figure 5:
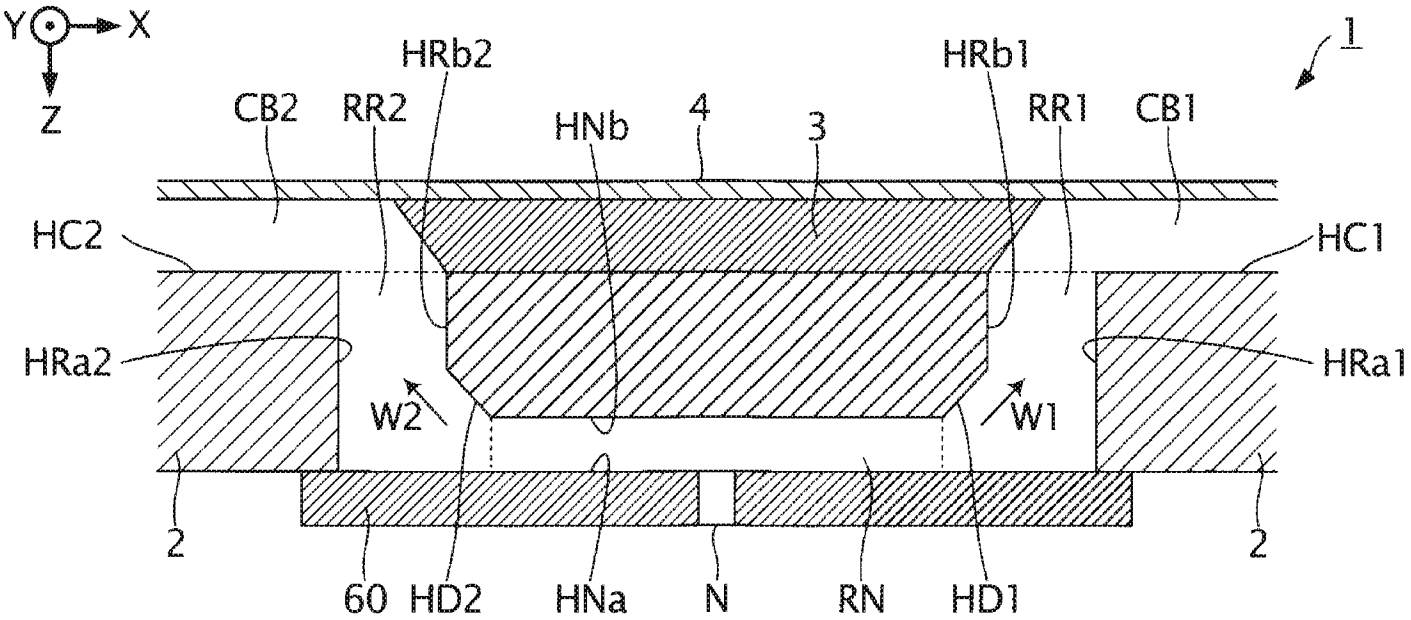
FIG. 5 is a sectional view illustrating an example of the configuration of the liquid ejecting head.

FIG. 5 is a sectional view of the circulation channel RJ for illustrating the pressure chamber CB1, the communication channel RR1, the nozzle channel RN, the communication channel RR2, and the pressure chamber CB2.

As illustrated in FIG. 5, the nozzle channel RN has a wall surface HNa on the +Z side and a wall surface HNb on the −Z side as viewed in the Y-axis direction. Here, the wall surface HNa is a wall surface in which the nozzle N is formed of the wall surfaces forming the nozzle channel RN and which extends in the X-axis direction as viewed in the Y-axis direction. The wall surface HNb is a wall surface which is opposite to the wall surface HNa of the two wall surfaces forming the nozzle channel RN as viewed in the Y-axis direction and which extends in the X-axis direction as viewed in the Y-axis direction.

The communication channel RR1 has a wall surface HRa1 on the +X side and a wall surface HRb1 on the −X side as viewed in the Y-axis direction. Here, the wall surface HRa1 is a wall surface a distance from which to the nozzle N in the X-axis direction is the longest of the wall surfaces forming the communication channel RR1 and which extends in the Z-axis direction as viewed in the Y-axis direction. Note that, in the present embodiment, it is assumed that a distance from one object to another object is the shortest distance from the object to the other object. The wall surface HRb1 is a wall surface which is opposite to the wall surface HRa1 of the two wall surfaces that form the communication channel RR1 and that extend in the Z-axis direction as viewed in the Y-axis direction.

The communication channel RR2 has a wall surface HRa2 on the −X side and a wall surface HRb2 on the +X side as viewed in the Y-axis direction. Here, the wall surface HRa2 is a wall surface a distance from which to the nozzle N in the X axis direction is the longest of the wall surfaces forming the communication channel RR2 and which extends in the Z-axis direction as viewed in the Y-axis direction. The wall surface HRb2 is a wall surface which is opposite to the wall surface HRa2 of the two wall surfaces that form the communication channel RR2 and that extend in the Z-axis direction as viewed in the Y-axis direction.

The pressure chamber CB1 has a wall surface HC1 as viewed in the Y-axis direction. Here, the wall surface HC1 is a wall surface on the +Z side of the two wall surfaces that form the pressure chamber CB1 and that extend in the X-axis direction as viewed in the Y-axis direction.

The pressure chamber CB2 has a wall surface HC2 as viewed in the Y-axis direction. Here, the wall surface HC2 is a wall surface on the +Z side of the two wall surfaces that form the pressure chamber CB2 and that extend in the X-axis direction as viewed in the Y-axis direction.

Note that, in the present embodiment, the nozzle N is provided at a substantially central position in the nozzle channel RN. For example, the distance from the nozzle N to the wall surface HRb1 in the X-axis direction and the distance from the nozzle N to the wall surface HRb2 in the X-axis direction may be substantially identical. Here, the term "the substantially central position" includes not only a case of being strictly the center but also a case of being regarded as the center within a tolerance.

As illustrated in FIG. 5, an inclined surface HD1 that extends in direction W1 as viewed in the Y-axis direction is provided between the wall surface HNb and the wall surface HRb1. More specifically, the inclined surface HD1 is provided so as to couple the wall surface HNb and the wall surface HRb1.

Here, direction W1 is set between the +X direction and the −Z direction. Note that, in the present embodiment, the inclined surface HD1 is provided such that angle θ11 formed between direction W1 and the +X direction is larger than 30° and smaller than 60° and angle θ12 formed between direction W1 and the −Z direction is larger than 30° and smaller than 60°. In other words, in the present embodiment, angle θ11 formed between the direction normal to the inclined surface HD1 and the direction normal to the wall surface HNb is larger than 30° and smaller than 60° and angle θ12 formed between the direction normal to the inclined surface HD1 and the direction normal to the wall surface HRb1 is larger than 30° and smaller than 60°. Note that it is sufficient that angle θ11 be larger than 20° and smaller than 80° and angle θ12 be larger than 10° and smaller than 70°. Further, angle θ11 and angle θ12 may be set to be substantially identical at, for example, 45°.

As illustrated in FIG. 5, an inclined surface HD2 that extends in direction W2 as viewed in the Y-axis direction is provided between the wall surface HNb and the wall surface HRb2. More specifically, the inclined surface HD2 is provided so as to couple the wall surface HNb and the wall surface HRb2.

Here, direction W2 is set between the −X direction and the −Z direction. Note that, in the present embodiment, the inclined surface HD2 is provided such that angle θ21 formed between direction W2 and the −X direction is larger than 30° and smaller than 60° and angle θ22 formed between direction W2 and the −Z direction is larger than 30° and smaller than 60°. In other words, in the present embodiment, angle θ21 formed between the direction normal to the inclined surface HD2 and the direction normal to the wall surface HNb is larger than 30° and smaller than 60° and angle θ22 formed between the direction normal to the inclined surface HD2 and the direction normal to the wall surface HRb2 is larger than 30° and smaller than 60°. Note that it is sufficient that angle θ21 be larger than 20° and smaller than 80° and angle θ22 be larger than 10° and smaller than 70°. Further, angle θ21 and angle θ22 may be set to be substantially identical at, for example, 45°. Angle θ21 and angle θ11 may be set to be substantially identical. Further, angle θ22 and angle θ12 may be set to be substantially identical.

Note that the wall surface HNa is coupled to the wall surface HRa1 and the wall surface HRa2. In other words, an inclined surface is provided neither between the wall surface HNa and the wall surface HRa1 nor between the wall surface HNa and the wall surface HRa2.

Moreover, the wall surface HRa1 is coupled to the wall surface HC1, and the wall surface HRa2 is coupled to the wall surface HC2. In other words, an inclined surface is provided neither between the wall surface HRa1 and the wall surface HC1 nor between the wall surface HRa2 and the wall surface HC2.

Figure 6:
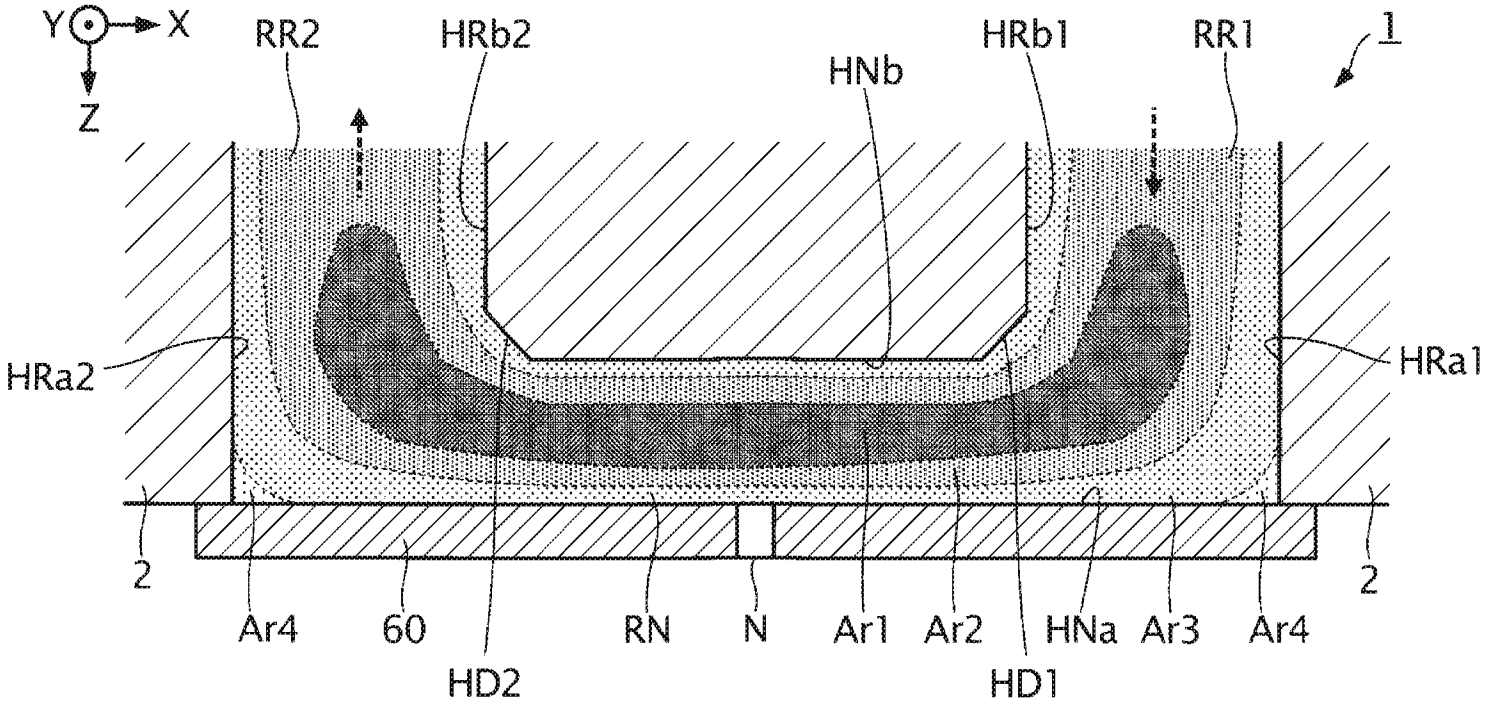
FIG. 6 is a view for explaining an example of the flow rate of ink in a circulation channel.

FIG. 6 is a view for explaining an example of the flow rate of the ink in the circulation channel RJ when the piezoelectric element PZq is not driven with the driving signal Com and no ink is ejected from the nozzle N and when the ink flows from the communication channel RR1 to the communication channel RR2 via the nozzle channel RN. Note that, in FIG. 6, an area Ar1 is an area in which the flow rate of the ink is velocity V1 or more, an area Ar2 is an area in which the flow rate of the ink is velocity V2 or more and less than the velocity V1, an area Ar3 is an area in which the flow rate of the ink is velocity V3 or more and less than the velocity V2, and an area Ar4 is an area in which the flow rate of the ink is less than the velocity V3. Here, it is assumed that the velocities V1 to V3 satisfy $0 \leq V3 < V2 < V1$.

As illustrated in FIG. 6, in the present embodiment, the flow rate of the ink in the vicinity of the center of the circulation channel RJ as viewed in the Y-axis direction is higher than the flow rate of the ink in the vicinity of the wall surface of the circulation channel RJ.

Specifically, in the present embodiment, the area Ar1 is in the vicinity of the center of the circulation channel RJ, the area Ar3 is in the vicinity of the wall surface of the circulation channel RJ, and the area Ar2 is between the area Ar1 and the area Ar3. In the present embodiment, the area Ar4 is in the vicinity of a portion in which the wall surface HNa and the wall surface HRa1 are coupled and in the vicinity of a portion in which the wall surface HNa and the wall surface HRa2 are coupled.

4. Reference Example

For clarifying the effect of the present embodiment, a liquid ejecting head 1Z according to a reference example will be described below with reference to FIGS. 7 and 8.

Figure 7:
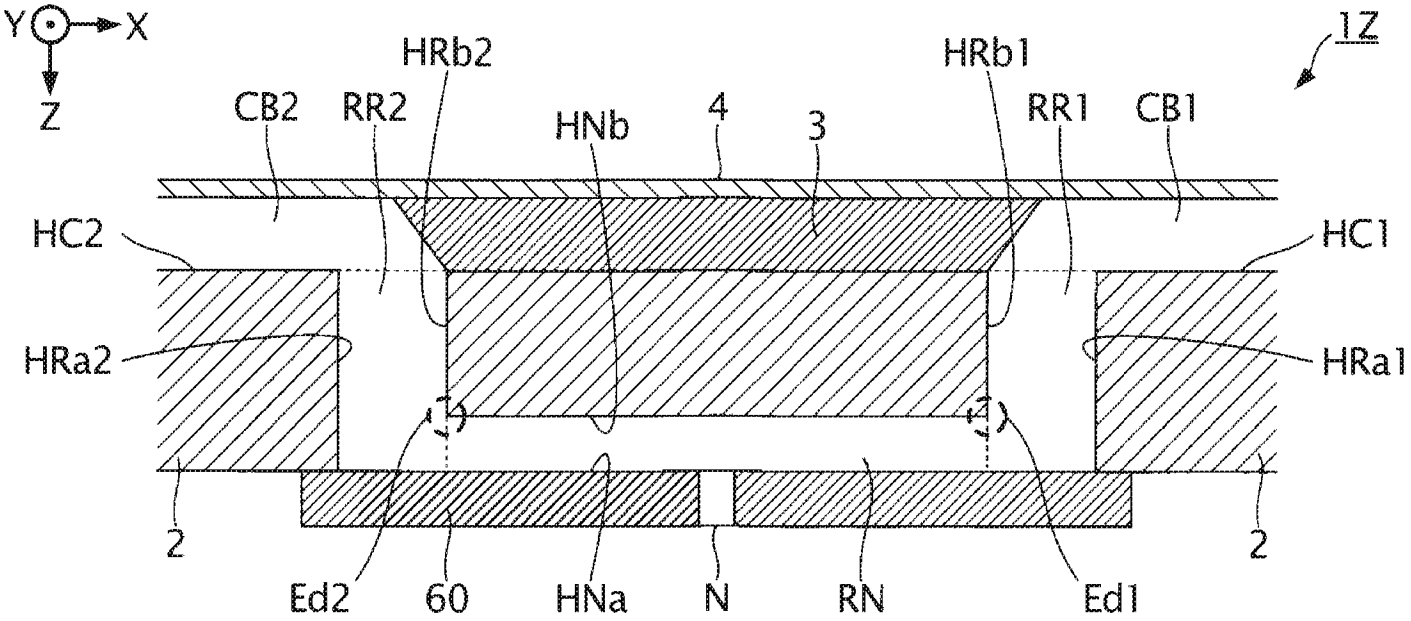
FIG. 7 is a sectional view illustrating an example of a configuration of a liquid ejecting head according to a reference example.

FIG. 7 is a sectional view of a circulation channel, which is provided in the liquid ejecting head 1Z according to the reference example, as viewed in the Y-axis direction.

As illustrated in FIG. 7, the liquid ejecting head 1Z is similar in configuration to the liquid ejecting head 1 according to the embodiment except that the wall surface HNb and the wall surface HRb1 are coupled and the inclined surface HD1 is not provided between the wall surface HNb and the wall surface HRb1 and except that the wall surface HNb and the wall surface HRb2 are coupled and the inclined surface HD2 is not provided between the wall surface HNb and the wall surface HRb2. That is, the liquid ejecting head 1Z according to the reference example is similar in configuration to the liquid ejecting head 1 according to the embodiment except that an edge Ed1 is formed in a portion in which the wall surface HNb and the wall surface HRb1 are coupled and except that an edge Ed2 is formed in a portion in which the wall surface HNb and the wall surface HRb2 are coupled.

Figure 8:
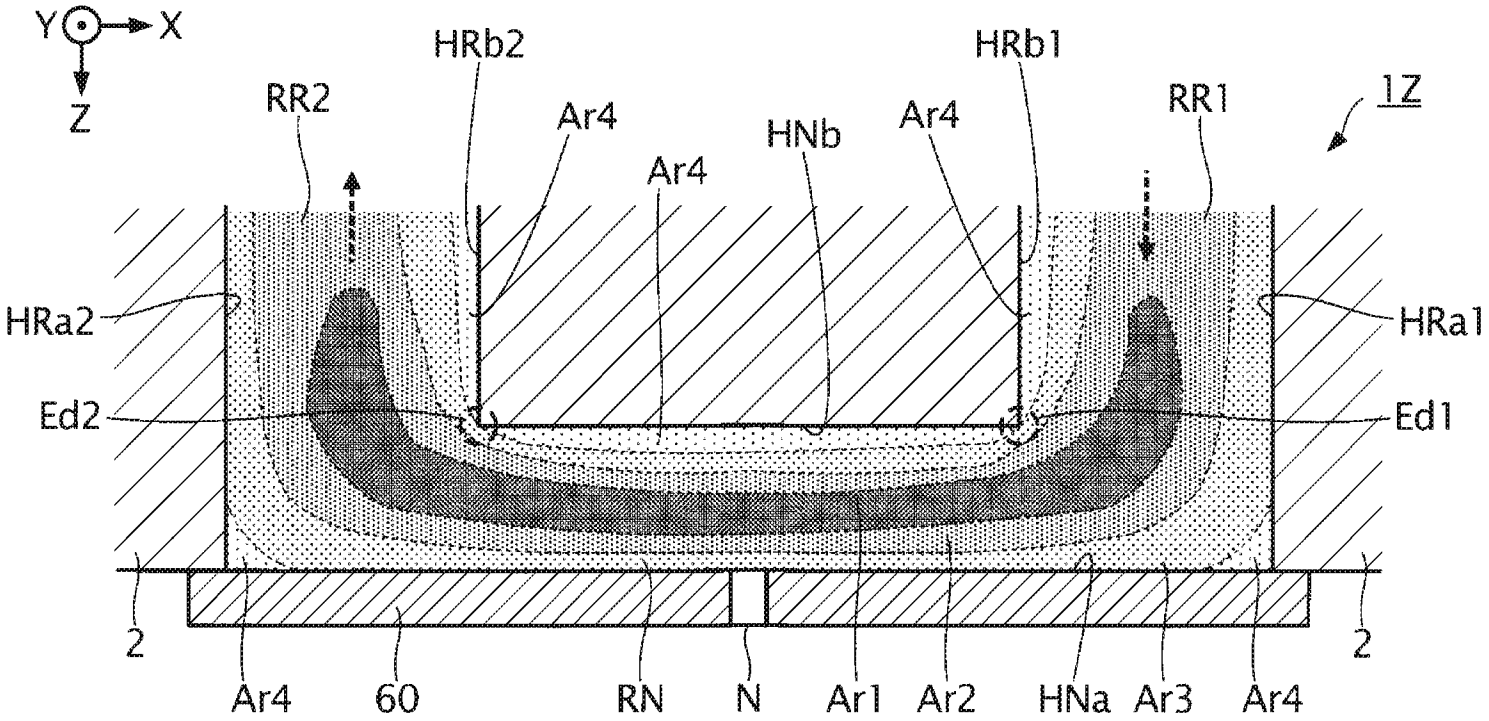
FIG. 8 is a view for explaining an example of the flow rate of ink in a circulation channel according to the reference example.

FIG. 8 is a view for explaining an example of the flow rate of the ink in the circulation channel when the piezoelectric element PZq of the liquid ejecting head 1Z according to the reference example is not driven with the driving signal Com and no ink is ejected from the nozzle N and when the ink flows from the communication channel RR1 to the communication channel RR2 via the nozzle channel RN.

As illustrated in FIG. 8, in the liquid ejecting head 1Z according to the reference example, the ink is prevented from flowing in the vicinity of the edge Ed1 and in the vicinity of the edge Ed2. Therefore, in the liquid ejecting head 1Z according to the reference example, the flow rate of the ink is reduced in the vicinity of the edge Ed1 and in the vicinity of the edge Ed2 compared with the flow rate in the liquid ejecting head 1 according to the embodiment. Thus, in the liquid ejecting head 1Z according to the reference example, the area Ar4 is in the vicinity of the edge Ed1 and in the vicinity of the edge Ed2. More specifically, in the liquid ejecting head 1Z according to the reference example, the area Ar4 is not only in the vicinity of the portion in which the wall surface HNa and the wall surface HRa1 are coupled and in the vicinity of the portion in which the wall surface HNa and the wall surface HRa2 are coupled but also in the vicinity of the wall surface HRb1, in the vicinity of the wall surface HNb, and in the vicinity of the wall surface HRb2.

Thus, in the liquid ejecting head 1Z according to the reference example, air bubbles readily remain in the vicinity of the wall surface HRb1, in the vicinity of the wall surface HNb, and in the vicinity of the wall surface HRb2 compared with the liquid ejecting head 1 according to the embodiment. In a case in which air bubbles remain in the circulation channel such as the nozzle channel RN, even when the piezoelectric element PZq is driven with the driving signal Com, for example, due to air bubbles absorbing the pressure applied from the piezoelectric element PZq for pushing out the ink, a so-called ejection abnormality that makes it difficult for the ink to be ejected from the nozzle N occurs. When an ejection abnormality occurs, the quality of an image formed on the medium PP is deteriorated. In particular, the air bubbles remaining in the circulation channel RJ between the piezoelectric element PZq and the nozzle N make it difficult for the ink to be ejected from the nozzle N upon driving of the piezoelectric element PZq. That is, when air bubbles remain on the +X side of the nozzle N in the vicinity of the wall surface HNb or remain in the vicinity of the wall surface HRb1, an ejection abnormality is more likely to occur during ejection of the ink upon driving of the piezoelectric element PZ1. Moreover, when air bubbles remain on the −X side of the nozzle N in the vicinity of the wall surface HNb or remain in the vicinity of the wall surface HRb2, an ejection abnormality is more likely to occur during ejection of the ink upon driving of the piezoelectric element PZ2.

On the other hand, in the liquid ejecting head 1 according to the present embodiment, the inclined surface HD1 is provided between the wall surface HNb and the wall surface HRb1, and the inclined surface HD2 is provided between the wall surface HNb and the wall surface HRb2. Therefore, the liquid ejecting head 1 according to the present embodiment is able to suppress a reduction in the flow rate of the ink in the vicinity of the wall surface HRb1, in the vicinity of the wall surface HNb, and in the vicinity of the wall surface HRb2, compared with the liquid ejecting head 1Z according to the reference example. Thus, the liquid ejecting head 1 according to the present embodiment is able to reduce the possibility of air bubbles remaining in the circulation channel RJ such as the nozzle channel RN and the possibility of an occurrence of an ejection abnormality caused by the air bubbles, compared with the liquid ejecting head 1Z according to the reference example. As a result, the liquid ejecting head 1 according to the present embodiment enables formation of an image having higher quality on the medium PP as compared with the liquid ejecting head 1Z according to the reference example.

5. Conclusion of Embodiment

As described above, the liquid ejecting head 1 according to the present embodiment includes: the pressure chamber CB1 that extends in the +X direction and applies pressure to the ink; the pressure chamber CB2 that extends in the +X direction and applies pressure to the ink; the nozzle channel RN that extends in the +X direction and communicates with the nozzle N for ejecting the ink; the communication channel RR1 that extends in the −Z direction crossing the +X direction and causes the pressure chamber CB1 and the nozzle channel RN to communicate with each other; and the communication channel RR2 that extends in the −Z direction and causes the pressure chamber CB2 and the nozzle channel RN to communicate with each other, in which wall surfaces of the nozzle channel RN include the wall surface HNa which extends in the +X direction and in which the nozzle N is provided and the wall surface HNb which extends in the +X direction and is opposite to the wall surface HNa, wall surfaces of the communication channel RR1 include the wall surface HRa1 which extends in the −Z direction and a distance from which to the nozzle N in the +X direction is the longest and the wall surface HRb1 which extends in the −Z direction and is opposite to the wall surface HRa1, and the inclined surface HD1 which extends in direction W1 set between the +X direction and the −Z direction is provided between the wall surface HNb and the wall surface HRb1.

That is, in the liquid ejecting head 1 according to the present embodiment, since the inclined surface HD1 is provided between the wall surface HNb and the wall surface HRb1, the ink flows more smoothly from the communication channel RR1 to the nozzle channel RN and from the nozzle channel RN to the communication channel RR1 compared with an aspect in which the inclined surface HD1 is not provided between the wall surface HNb and the wall surface HRb1. Therefore, the liquid ejecting head 1 according to the present embodiment is able to reduce the possibility of air bubbles remaining in the communication channel RR1 or the nozzle channel RN compared with an aspect in which the inclined surface HD1 is not provided between the wall surface HNb and the wall surface HRb1. Thereby, the liquid ejecting head 1 according to the present embodiment is able to reduce the possibility of an occurrence of an ejection abnormality caused by the air bubbles compared with the aspect in which the inclined surface HD1 is not provided between the wall surface HNb and the wall surface HRb1.

Moreover, in the liquid ejecting head 1 according to the present embodiment, since the pressure chamber CB1 and the pressure chamber CB2 communicate with each other via the communication channel RR1, the nozzle channel RN, and the communication channel RR2, a flow of ink is able to be produced between the pressure chamber CB1 and the pressure chamber CB2. Therefore, the liquid ejecting head 1 according to the present embodiment is able to reduce the possibility of air bubbles remaining in the nozzle channel RN or the like compared with an aspect in which the pressure chamber CB1 and the pressure chamber CB2 do not communicate with each other. Thereby, the liquid ejecting head 1 according to the present embodiment is able to reduce the possibility of an occurrence of an ejection abnormality caused by the air bubbles compared with the aspect in which the pressure chamber CB1 and the pressure chamber CB2 do not communicate with each other.

Note that, in the present embodiment, the pressure chamber CB1 is an example of "a first pressure chamber", the pressure chamber CB2 is an example of "a second pressure chamber", the communication channel RR1 is an example of "a first communication channel", the communication channel RR2 is an example of "a second communication channel", the wall surface HNa is an example of "a first wall surface", the wall surface HNb is an example of "a second wall surface", the wall surface HRa1 is an example of "a third wall surface", the wall surface HRb1 is an example of "a fourth wall surface", the inclined surface HD1 is an example of "a fifth wall surface", ink is an example of "a liquid", the +X direction is an example of "a first direction", the −Z direction is an example of "a second direction", and direction W1 is an example of "a third direction".

Moreover, the liquid ejecting head 1 according to the present embodiment includes: the pressure chamber CB2 that extends in the −X direction and applies pressure to the ink; the pressure chamber CB1 that extends in the −X direction and applies pressure to the ink; the nozzle channel RN that extends in the −X direction and communicates with the nozzle N for ejecting the ink; the communication channel RR2 that extends in the −Z direction and causes the pressure chamber CB2 and the nozzle channel RN to communicate with each other; and the communication channel RR1 that extends in the −Z direction and causes the pressure chamber CB1 and the nozzle channel RN to communicate with each other, in which wall surfaces of the nozzle channel RN include the wall surface HNa which extends in the −X direction and in which the nozzle N is provided and the wall surface HNb which extends in the −X direction and is opposite to the wall surface HNa, wall surfaces of the communication channel RR2 include the wall surface HRa2 which extends in the −Z direction and a distance from which to the nozzle N in the −X direction is the longest and the wall surface HRb2 which extends in the −Z direction and is opposite to the wall surface HRa2, and the inclined surface HD2 which extends in direction W2 set between the −X direction and the −Z direction is provided between the wall surface HNb and the wall surface HRb2.

Thus, the liquid ejecting head 1 according to the present embodiment is able to reduce the possibility of air bubbles remaining in the communication channel RR2 or the nozzle channel RN compared with an aspect in which the inclined surface HD2 is not provided between the wall surface HNb and the wall surface HRb2. Thereby, the liquid ejecting head 1 according to the present embodiment is able to reduce the possibility of an occurrence of an ejection abnormality caused by the air bubbles compared with the aspect in which the inclined surface HD2 is not provided between the wall surface HNb and the wall surface HRb2.

Moreover, the liquid ejecting head 1 according to the present embodiment is able to reduce the possibility of air bubbles remaining in the nozzle channel RN or the like compared with the aspect in which the pressure chamber CB1 and the pressure chamber CB2 do not communicate with each other. Thereby, the liquid ejecting head 1 according to the present embodiment is able to reduce the possibility of an occurrence of an ejection abnormality caused by the air bubbles compared with the aspect in which the pressure chamber CB1 and the pressure chamber CB2 do not communicate with each other.

In particular, the pressure chamber CB2 is positioned on the downstream of the nozzle N in the direction in which the ink flows in the circulation channel RJ. Since air bubbles that have entered from the nozzle N flow partially together with the flow of the ink, the air bubbles tend to move to the downstream of the nozzle N rather than to the upstream of the nozzle N. That is, air bubbles remain on the −X side of the wall surface HNb with respect to the nozzle N and on the wall surface HRb2 more readily than on the +X side of the wall surface HNb with respect to the nozzle N and on the wall surface HRb1. Here, when the piezoelectric element PZ2 is not provided on the downstream of the nozzle N, a remarkable ejection abnormality is not caused by the air bubbles remaining on the downstream of the nozzle N. However, when the piezoelectric element PZ2 is provided on the downstream of the nozzle N as in the present embodiment, air bubbles readily remain on the downstream of the nozzle N in the circulation channel RJ, and therefore, an ejection abnormality may remarkably occur during ejection of the ink upon driving of the piezoelectric element PZ2. Against this, according to the present embodiment, since the inclined surface HD2 is provided on the downstream of the nozzle N, even when the piezoelectric element PZ2 is provided on the downstream of the nozzle N, it is possible to suppress an occurrence of an ejection abnormality.

Note that, in the present embodiment, the pressure chamber CB2 is another example of "the first pressure chamber", the pressure chamber CB1 is another example of "the second pressure chamber", the communication channel RR2 is another example of "the first communication channel", the communication channel RR1 is another example of "the second communication channel", the wall surface HRa2 is another example of "the third wall surface", the wall surface HRb2 is another example of "the fourth wall surface", the inclined surface HD2 is another example of "the fifth wall surface", the −X direction is another example of "the first direction", and direction W2 is another example of "the third direction".

Moreover, in the liquid ejecting head 1 according to the present embodiment, angle θ11 formed between the direction normal to the wall surface HNb and the direction normal to the inclined surface HD1 may be larger than 20° and smaller than 80°.

Therefore, the liquid ejecting head 1 according to the present embodiment is able to reduce the possibility of air bubbles remaining in the communication channel RR1 or the nozzle channel RN compared with an aspect in which the inclined surface HD1 is not provided between the wall surface HNb and the wall surface HRb1 and an angle formed between the direction normal to the wall surface HNb and the direction normal to the wall surface HRb1 is, for example, 90°. As a result, the liquid ejecting head 1 according to the present embodiment is able to reduce the possibility of an occurrence of an ejection abnormality caused by the air bubbles compared with the aspect in which the inclined surface HD1 is not provided between the wall surface HNb and the wall surface HRb1.

Moreover, in the liquid ejecting head 1 according to the present embodiment, angle θ12 formed between the direction normal to the wall surface HRb1 and the direction normal to the inclined surface HD1 may be larger than 10° and smaller than 70°.

Therefore, according to the present embodiment, it is possible to reduce the possibility of air bubbles remaining in the communication channel RR1 or the nozzle channel RN compared with an aspect in which the inclined surface HD1 is not provided between the wall surface HNb and the wall surface HRb1 and the angle formed between the direction normal to the wall surface HNb and the direction normal to the wall surface HRb1 is, for example, 90°. As a result, the liquid ejecting head 1 according to the present embodiment is able to reduce the possibility of an occurrence of an ejection abnormality caused by the air bubbles compared with the aspect in which the inclined surface HD1 is not provided between the wall surface HNb and the wall surface HRb1.

Moreover, in the liquid ejecting head 1 according to the present embodiment, the wall surface HNa is coupled to the wall surface HRa1.

Therefore, according to the present embodiment, it is possible to easily manufacture the liquid ejecting head 1 compared with an aspect in which another component is provided between the wall surface HNa and the wall surface HRa1.

Moreover, in the liquid ejecting head 1 according to the present embodiment, a wall surface of the pressure chamber CB1 may include the wall surface HC1 that extends in the +X direction, and the wall surface HRa1 may be coupled to the wall surface HC1. Therefore, according to the present embodiment, it is possible to easily manufacture the liquid ejecting head 1 compared with an aspect in which another component is provided between the wall surface HRa1 and the wall surface HC1.

Note that, in the present embodiment, the wall surface HC1 is an example of "a sixth wall surface".

Moreover, in the liquid ejecting head 1 according to the present embodiment, wall surfaces of the communication channel RR2 may include the wall surface HRa2 which extends in the −Z direction and a distance from which to the nozzle N in the +X direction is the longest and the wall surface HRb2 which extends in the −Z direction and is opposite to the wall surface HRa2, and the inclined surface HD2 which extends in direction W2 set between the −X direction and the −Z direction may be provided between the wall surface HNb and the wall surface HRb2. Therefore, according to the present embodiment, it is possible to reduce the possibility of air bubbles remaining in the communication channel RR2 or the nozzle channel RN compared with the aspect in which the inclined surface HD2 is not provided between the wall surface HNb and the wall surface HRb2. As a result, the liquid ejecting head 1 according to the present embodiment is able to reduce the possibility of an occurrence of an ejection abnormality caused by the air bubbles compared with the aspect in which the inclined surface HD2 is not provided between the wall surface HNb and the wall surface HRb2.

Note that, in the present embodiment, the wall surface HRa2 is an example of "a seventh wall surface", the wall surface HRb2 is an example of "an eighth wall surface", the inclined surface HD2 is an example of "a ninth wall surface", and direction W2 is an example of "a fourth direction".

Moreover, in the liquid ejecting head 1 according to the present embodiment, angle θ12 formed between direction W1 and the −Z direction may be substantially identical to angle θ22 formed between direction W2 and the −Z direction. Therefore, according to the present embodiment, the shape of an ink channel that extends from the pressure chamber CB1 to the nozzle N via the communication channel RR1 and the nozzle channel RN is able to be substantially identical to the shape of an ink channel that extends from the pressure chamber CB2 to the nozzle N via the communication channel RR2 and the nozzle channel RN. Thereby, according to the present embodiment, it is possible to simplify control for ejecting the ink filled in the pressure chamber CB1 from the nozzle N and control for ejecting the ink filled in the pressure chamber CB2 from the nozzle N, for example, compared with an aspect in which angle θ12 differs from angle θ22.

Moreover, the liquid ejecting head 1 according to the present embodiment may include the supply channel RA1 which communicates with the pressure chamber CB1 and along which the ink is supplied to the pressure chamber CB1 and the discharge channel RA2 which communicates with the pressure chamber CB2 and along which the ink is discharged from the pressure chamber CB2.

Therefore, according to the present embodiment, a flow of the ink is able to be produced between the pressure chamber CB1 and the pressure chamber CB2. Thus, the liquid ejecting head 1 according to the present embodiment is able to reduce the possibility of air bubbles remaining in the nozzle channel RN or the like compared with an aspect in which no flow of ink is produced between the pressure chamber CB1 and the pressure chamber CB2. As a result, the liquid ejecting head 1 according to the present embodiment is able to reduce the possibility of an occurrence of an ejection abnormality caused by the air bubbles compared with the aspect in which no flow of ink is produced between the pressure chamber CB1 and the pressure chamber CB2.

Moreover, the liquid ejecting head 1 according to the present embodiment may include the pressure chamber substrate 3 in which the pressure chamber CB1 and the pressure chamber CB2 are provided, the communication plate 2 in which the nozzle channel RN, the communication channel RR1, and the communication channel RR2 are provided, and the nozzle substrate 60 in which the nozzle N is provided.

Therefore, according to the present embodiment, it is possible to manufacture the pressure chamber CB1, the pressure chamber CB2, the nozzle channel RN, the communication channel RR1, the communication channel RR2, and the nozzle N by using a semiconductor manufacturing technique. Further, according to the present embodiment, it is possible to achieve miniaturization and densification of the pressure chamber CB1, the pressure chamber CB2, the nozzle channel RN, the communication channel RR1, the communication channel RR2, and the nozzle N.

Moreover, in the liquid ejecting head 1 according to the present embodiment, the nozzle N may communicate with the nozzle channel RN at a substantially central position of the nozzle channel RN.

Therefore, according to the present embodiment, the shape of the ink channel that extends from the pressure chamber CB1 to the nozzle N via the communication channel RR1 and the nozzle channel RN is able to be substantially identical to the shape of the ink channel that extends from the pressure chamber CB2 to the nozzle N via the communication channel RR2 and the nozzle channel RN. Thereby, according to the present embodiment, it is possible to simplify control for ejecting the ink filled in the pressure chamber CB1 from the nozzle N and control for ejecting the ink filled in the pressure chamber CB2 from the nozzle N, for example, compared with an aspect in which the nozzle N communicates with the nozzle channel RN at a position different from the center of the nozzle channel RN.

Moreover, the liquid ejecting head 1 according to the present embodiment may include the piezoelectric element PZ1 that applies pressure to the ink in the pressure chamber CB1 in response to supply of the driving signal Com1 and the piezoelectric element PZ2 that applies pressure to the ink in the pressure chamber CB2 in response to supply of the driving signal Com2. Therefore, according to the present embodiment, it is possible to increase the amount of the ink ejected from the nozzle N compared with an aspect in which only the piezoelectric element PZq that applies pressure to the ink in one pressure chamber CBq is provided.

Note that, in the present embodiment, the piezoelectric element PZ1 is an example of "a first element", the piezoelectric element PZ2 is an example of "a second element", the driving signal Com1 is an example of "a first driving signal", and the driving signal Com2 is an example of "a second driving signal".

Moreover, in the liquid ejecting head 1 according to the present embodiment, the waveform of the driving signal Com1 and the waveform of the driving signal Com2 may be substantially identical.

Therefore, according to the present embodiment, it is possible to simplify control for ejecting the ink filled in the pressure chamber CB1 from the nozzle N and control for ejecting the ink filled in the pressure chamber CB2 from the nozzle N compared with an aspect in which the waveform of the driving signal Com 1 differs from the waveform of the driving signal Com2.

B. Modification

Each aspect exemplified above can be variously modified. Specific modified aspects will be exemplified below. Any two or more aspects selected from the following examples can be appropriately combined as long as the aspects do not contradict each other.

Modification 1

Although an aspect in which the wall surface HNa and the wall surface HRa1 are coupled and the wall surface HNa and the wall surface HRa2 are coupled is exemplified in the embodiment described above, the disclosure is not limited to the aspect. For example, another wall surface may be provided between the wall surface HNa and the wall surface HRa1 or another wall surface may be provided between the wall surface HNa and the wall surface HRa2.

Figure 9:
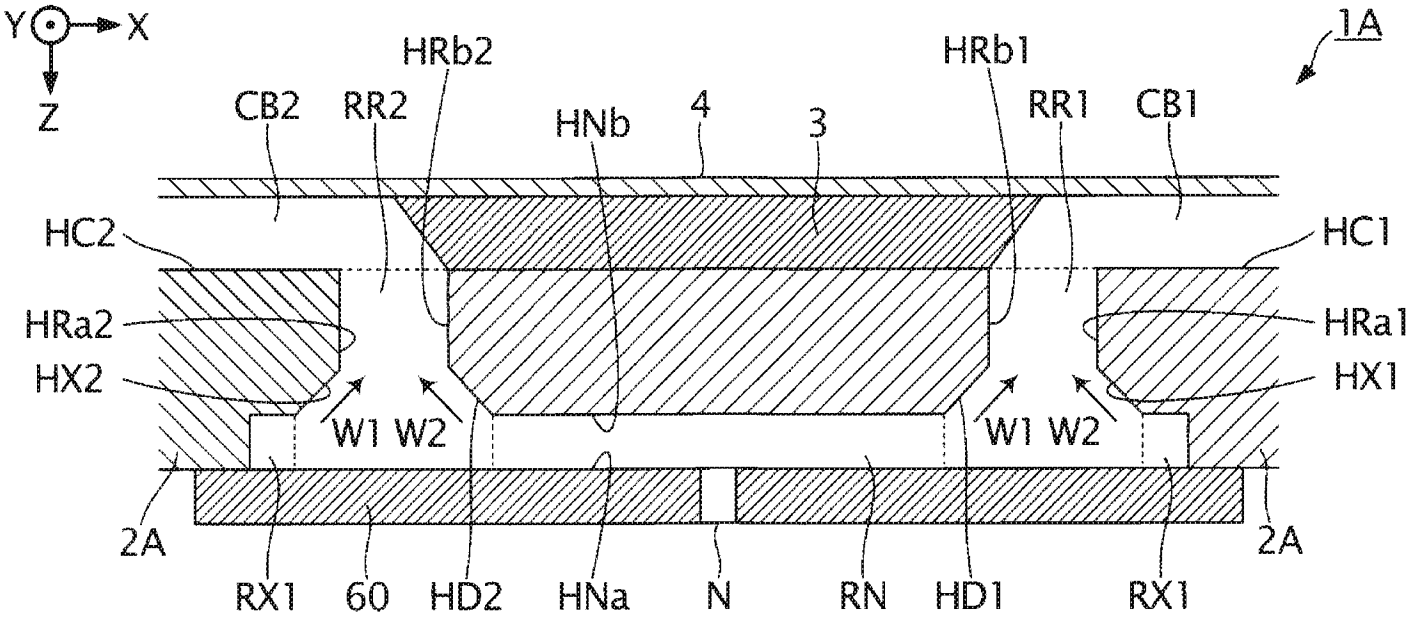
FIG. 9 is a sectional view illustrating an example of a configuration of a liquid ejecting head according to Modification 1.

FIG. 9 is a sectional view of a liquid ejecting head 1A according to the present modification. The liquid ejecting head 1A according to the present modification is similar in configuration to the liquid ejecting head 1 except that a communication plate 2A is provided instead of the communication plate 2.

As illustrated in FIG. 9, the communication plate 2A differs from the communication plate 2 according to the embodiment in terms of including a cavity RX1 and a cavity RX2. Here, the cavity RX1 communicates with the nozzle channel RN and is provided on the +X side of the nozzle channel RN. The cavity RX2 communicates with the nozzle channel RN and is provided on the −X side of the nozzle channel RN. Note that an inclined surface HX1 that extends in direction W2 as viewed in the Y-axis direction may be provided between a wall surface of the cavity RX1 and the wall surface HRa1. An inclined surface HX2 that extends in direction W1 as viewed in the Y-axis direction may be provided between a wall surface of the cavity RX2 and the wall surface HRa2.

Also in the present modification, since the inclined surface HD1 is provided between the wall surface HNb and the wall surface HRb1, it is possible to reduce the possibility of air bubbles remaining in the communication channel RR1 or the nozzle channel RN compared with the aspect in which the inclined surface HD1 is not provided between the wall surface HNb and the wall surface HRb1. Further, also in the present modification, since the inclined surface HD2 is provided between the wall surface HNb and the wall surface HRb2, it is possible to reduce the possibility of air bubbles remaining in the communication channel RR2 or the nozzle channel RN compared with the aspect in which the inclined surface HD2 is not provided between the wall surface HNb and the wall surface HRb2.

Modification 2

Although an aspect in which two piezoelectric elements PZq of the piezoelectric element PZ1 and the piezoelectric element PZ2 are provided so as to correspond to each of the nozzles N is exemplified in the embodiment and Modification 1 described above, the disclosure is not limited to the aspect. For example, one piezoelectric element PZ may be provided so as to correspond to each of the nozzles N.

Figure 10:
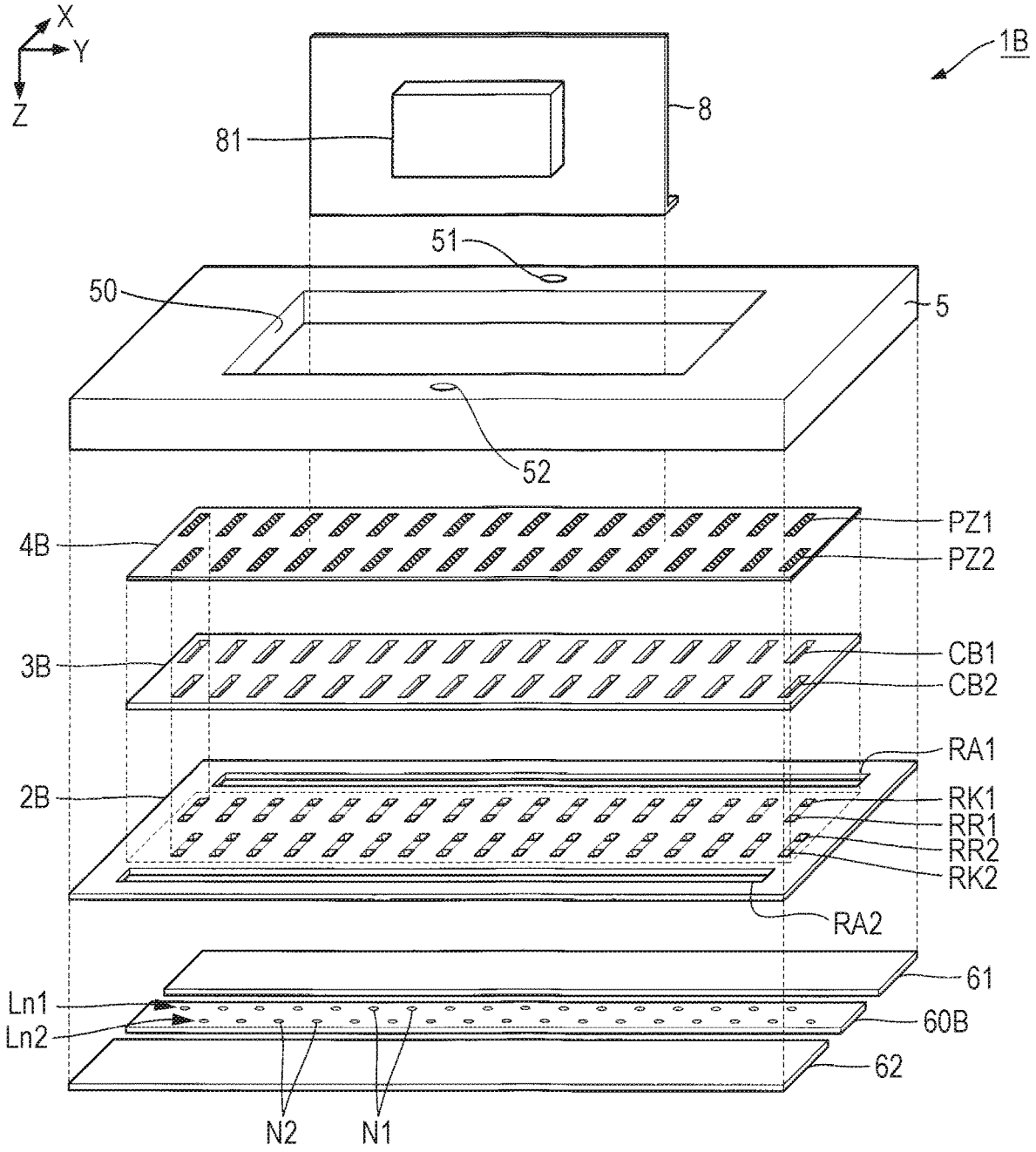
FIG. 10 is an exploded perspective view illustrating an example of a configuration of a liquid ejecting head according to Modification 2.

FIG. 10 is an exploded perspective view of a liquid ejecting head 1B according to the present modification.

As illustrated in FIG. 10, the liquid ejecting head 1B according to the present modification differs from the liquid ejecting head 1 of the embodiment in terms of including a nozzle substrate 60B instead of the nozzle substrate 60, including the communication plate 2B instead of the communication plate 2, including a pressure chamber substrate 3B instead of the pressure chamber substrate 3, and including a vibrating plate 4B instead of the vibrating plate 4.

Among these, the nozzle substrate 60B differs from the nozzle substrate 60 according to the embodiment in terms of including a nozzle row Ln1 and a nozzle row Ln2 instead of the nozzle row Ln. Here, the nozzle row Ln1 is a set of M1 nozzles N that are provided so as to extend in the Y-axis direction. The nozzle row Ln2 is a set of M2 nozzles N that are provided, on the −X side of the nozzle row Ln1, so as to extend in the Y axis direction. Here, values of M1 and M2 are natural numbers of 1 or more that satisfy M1+M2=M. Note that, in the present modification, a case where the value of M is a natural number of 2 or more is assumed. Moreover, in the following description, the nozzles N that form the nozzle row Ln1 are sometimes referred to as nozzles N1 and the nozzles N that form the nozzle row Ln2 are sometimes referred to as nozzles N2.

The communication plate 2B differs from the communication plate 2 according to the embodiment in terms of including M1 coupling channels RK1 corresponding on a one-to-one basis to M1 nozzles N1, M2 coupling channels RK2 corresponding on a one-to-one basis to M2 nozzles N2, M1 communication channels RR1 corresponding on a one-to-one basis to the M1 nozzles N1, and M2 communication channels RR2 corresponding on a one-to-one basis to the M2 nozzles N2 instead of the M coupling channels RK1, the M coupling channels RK2, the M communication channels RR1, and the M communication channels RR2. Further, similarly to the communication plate 2, the supply channel RA1 that extends in the Y-axis direction and the discharge channel RA2 that is provided, in the −X direction as viewed from the supply channel RA1, so as to extend in the Y-axis direction are formed in the communication plate 2B.

Moreover, the pressure chamber substrate 3B differs from the pressure chamber substrate 3 according to the embodiment in that M1 pressure chambers CB1 corresponding on a one-to-one basis to the M1 nozzles N1 and M2 pressure chambers CB2 corresponding on a one-to-one basis to the M2 nozzles N2 are formed instead of the M pressure chambers CB1 and the M pressure chambers CB2.

Moreover, the vibrating plate 4B differs from the vibrating plate 4 according to the embodiment in that M1 piezoelectric elements PZ1 corresponding on a one-to-one basis to the M1 nozzles N1 and M2 piezoelectric elements PZ2 corresponding on a one-to-one basis to the M2 nozzles N2 are formed instead of the M piezoelectric elements PZ1 and the M piezoelectric elements PZ2.

Figure 11:
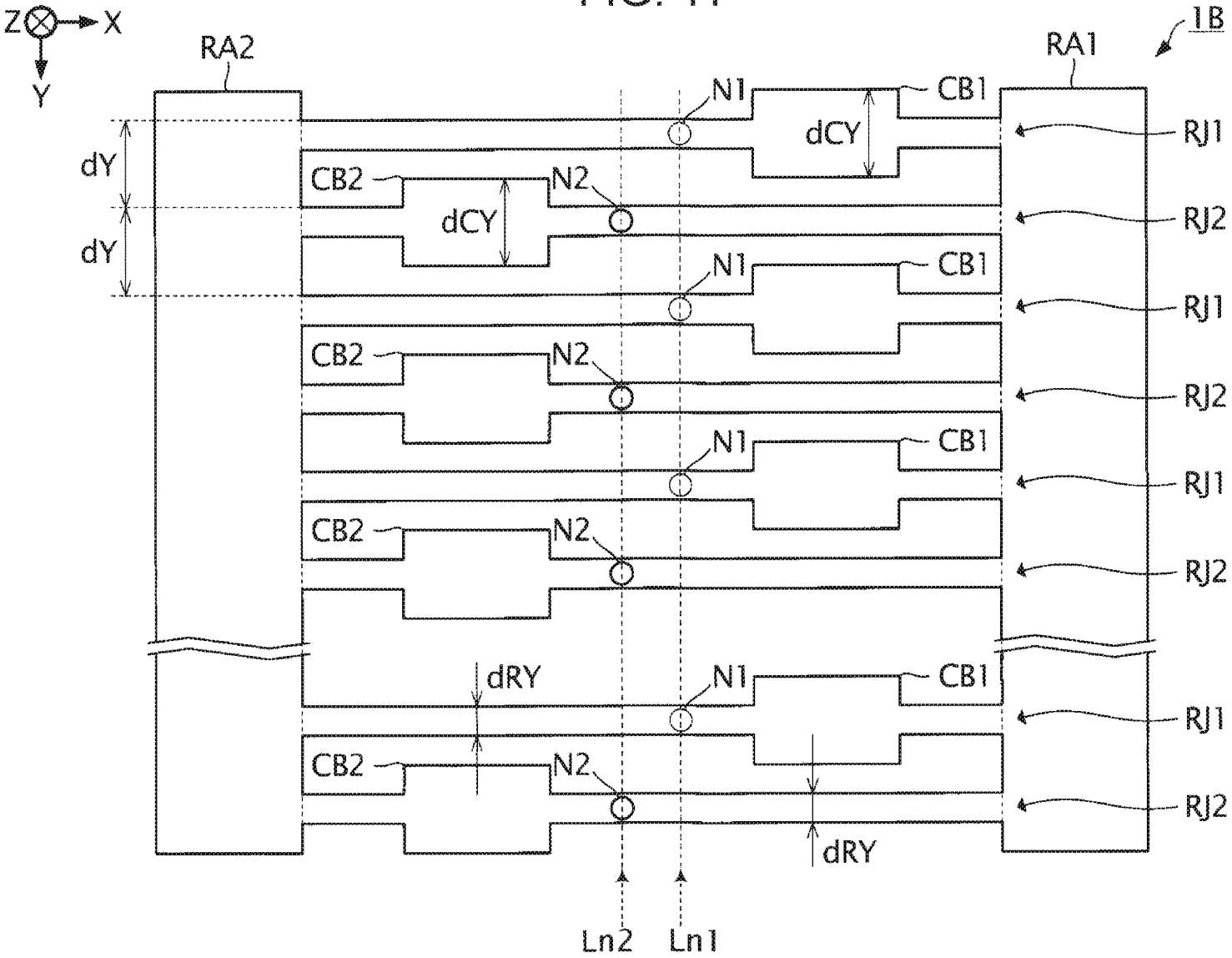
FIG. 11 is a plan view illustrating an example of the configuration of the liquid ejecting head according to Modification 2.

FIG. 11 is a plan view of the liquid ejecting head 1B as viewed in the Z-axis direction.

In the present modification, the liquid ejecting head 1B includes M circulation channels RJ corresponding on a one-to-one basis to the M nozzles N provided in the nozzle substrates 60B. In the following description, circulation channels RJ provided so as to correspond to the nozzles N1 are sometimes referred to as circulation channels RJ1, and circulation channels RJ provided so as to correspond to the nozzles N2 are sometimes referred to as circulation channels RJ2. That is, in the present modification, M1 circulation channels RJ1 and M2 circulation channels RJ2 cause the supply channel RA1 and the discharge channel RA2 to communicate with each other. In the present modification, a circulation channel RJ1 and a circulation channel RJ2 are alternately arranged in the Y-axis direction. Moreover, in the present modification, the M1 circulation channels RJ1 and the M2 circulation channels RJ2 are arranged such that a distance between the circulation channel RJ1 and the circulation channel RJ2 that are adjacent to each other in the Y-axis direction is a distance dY.

As described above, the circulation channel RJ1 has the pressure chamber CB1, and the circulation channel RJ2 has the pressure chamber CB2. In the present modification, as illustrated in FIG. 11, the pressure chamber CB1 is provided on the +X side of a nozzle N1, the pressure chamber CB2 is provided on the −X side of a nozzle N2. As described above, the nozzle row Ln1 to which the nozzles N1 belong is provided on the +X side of the nozzle row Ln2 to which the nozzles N2 belong. Therefore, in the present modification, the pressure chamber CB1 is positioned on the +X side of the pressure chamber CB2.

In the present modification, the circulation channel RJ is provided such that the width of the pressure chamber CBq in the Y-axis direction is width dCY and a width of a portion other than the pressure chamber CBq is width dRY or less. In the present modification, a case where width dRY and width dCY satisfy dRY<dCY is assumed. Further, in the present modification, as an example, a case where the M1 circulation channels RJ1 and the M2 circulation channels RJ2 are provided such that the distance dY and the width dCY satisfy dCY>dY is assumed.

As described above, in the present modification, since the position of the pressure chamber CB1 in the X-axis direction differs from the position of the pressure chamber CB2 in the X-axis direction, a pitch at which circulation channels RJ are provided is able to be narrowed compared with an aspect in which the pressure chamber CB1 and the pressure chamber CB2 are provided at the same position in the X-axis direction.

Figure 12:
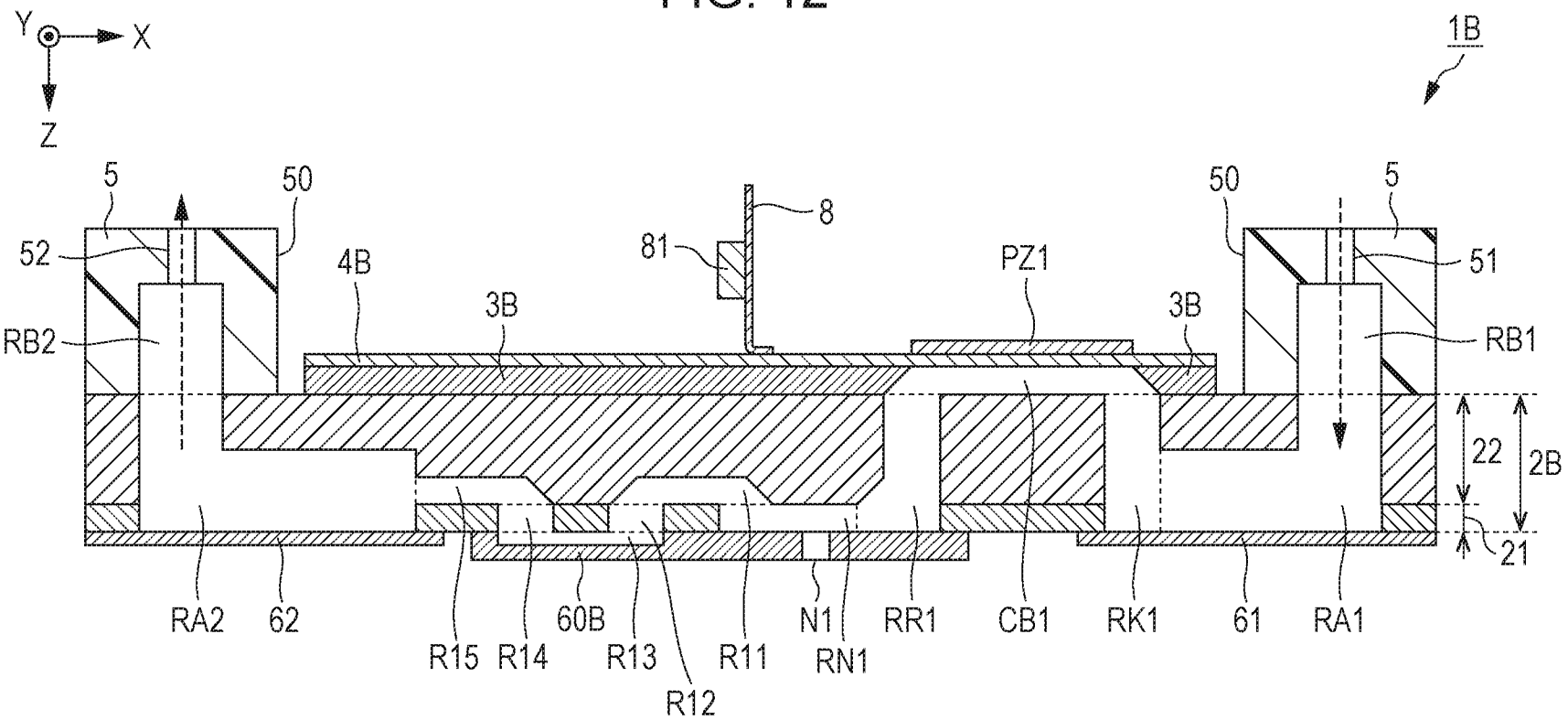
FIG. 12 is a sectional view illustrating an example of the configuration of the liquid ejecting head according to Modification 2.
Figure 13:
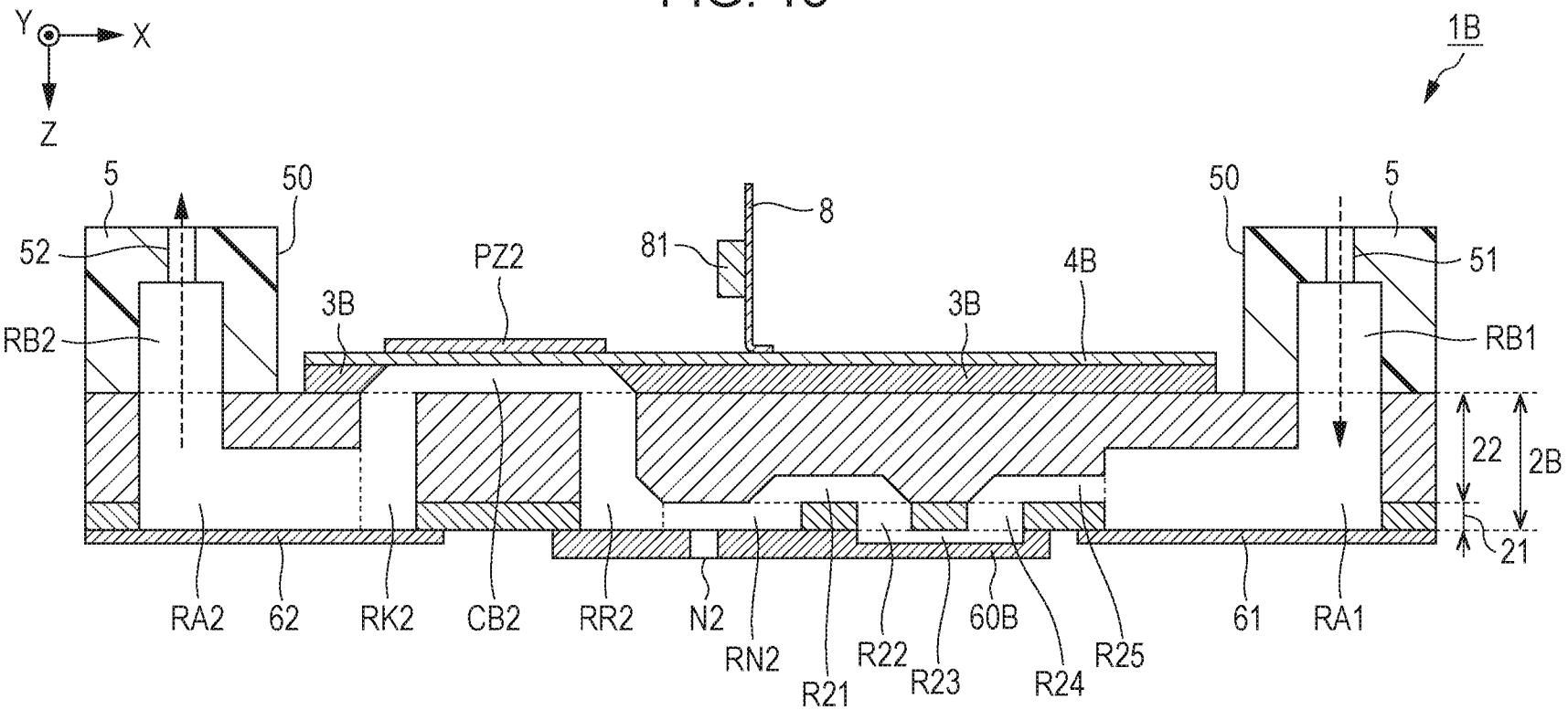
FIG. 13 is a sectional view illustrating an example of the configuration of the liquid ejecting head according to Modification 2.

FIG. 12 is a sectional view of the liquid ejecting head 1B, which is taken parallel to the XZ plane so as to pass through the circulation channel RJ1. FIG. 13 is a sectional view of the liquid ejecting head 1B, which is taken parallel to the XZ plane so as to pass through the circulation channel RJ2.

As illustrated in FIGS. 12 and 13, in the present modification, the communication plate 2B includes a substrate 21 and a substrate 22. Here, each of the substrate 21 and the substrate 22 is manufactured, for example, in such a manner that a silicon monocrystalline substrate is processed by using a semiconductor manufacturing technique such as etching. Note that any known material and process can be adopted to manufacture each of the substrate 21 and the substrate 22.

As illustrated in FIG. 12, in the present modification, the circulation channel RJ1 includes the coupling channel RK1 that communicates with the supply channel RA1 and is formed in the substrate 21 and the substrate 22, the pressure chamber CB1 that communicates with the coupling channel RK1 and is formed in the pressure chamber substrate 3B, the communication channel RR1 that communicates with the pressure chamber CB1 and is formed in the substrate 21 and the substrate 22, a nozzle channel RN1 that communicates with the communication channel RR1 and the nozzle N1 and is formed in the substrate 21, a channel R11 that communicates with the nozzle channel RN1 and is formed in the substrate 22, a channel R12 that communicates with the channel R11 and is formed in the substrate 21, a channel R13 that communicates with the channel R12 and is formed in the nozzle substrate 60B, a channel R14 that communicates with the channel R13 and is formed in the substrate 21, and a channel R15 that causes the channel R14 and the discharge channel RA2 to communicate with each other and is formed in the substrate 22.

As illustrated in FIG. 13, in the present modification, the circulation channel RJ2 includes the coupling channel RK2 that communicates with the discharge channel RA2 and is formed in the substrate 21 and the substrate 22, the pressure chamber CB2 that communicates with the coupling channel RK2 and is formed in the pressure chamber substrate 3B, the communication channel RR2 that communicates with the pressure chamber CB2 and is formed in the substrate 21 and the substrate 22, a nozzle channel RN2 that communicates with the communication channel RR2 and the nozzle N2 and is formed in the substrate 21, a channel R21 that communicates with the nozzle channel RN2 and is formed in the substrate 22, a channel R22 that communicates with the channel R21 and is formed in the substrate 21, a channel R23 that communicates with the channel R22 and is formed in the nozzle substrate 60B, a channel R24 that communicates with the channel R23 and is formed in the substrate 21, and a channel R25 that causes the channel R24 and the supply channel RA1 to communicate with each other and is formed in the substrate 22.

Figure 14:
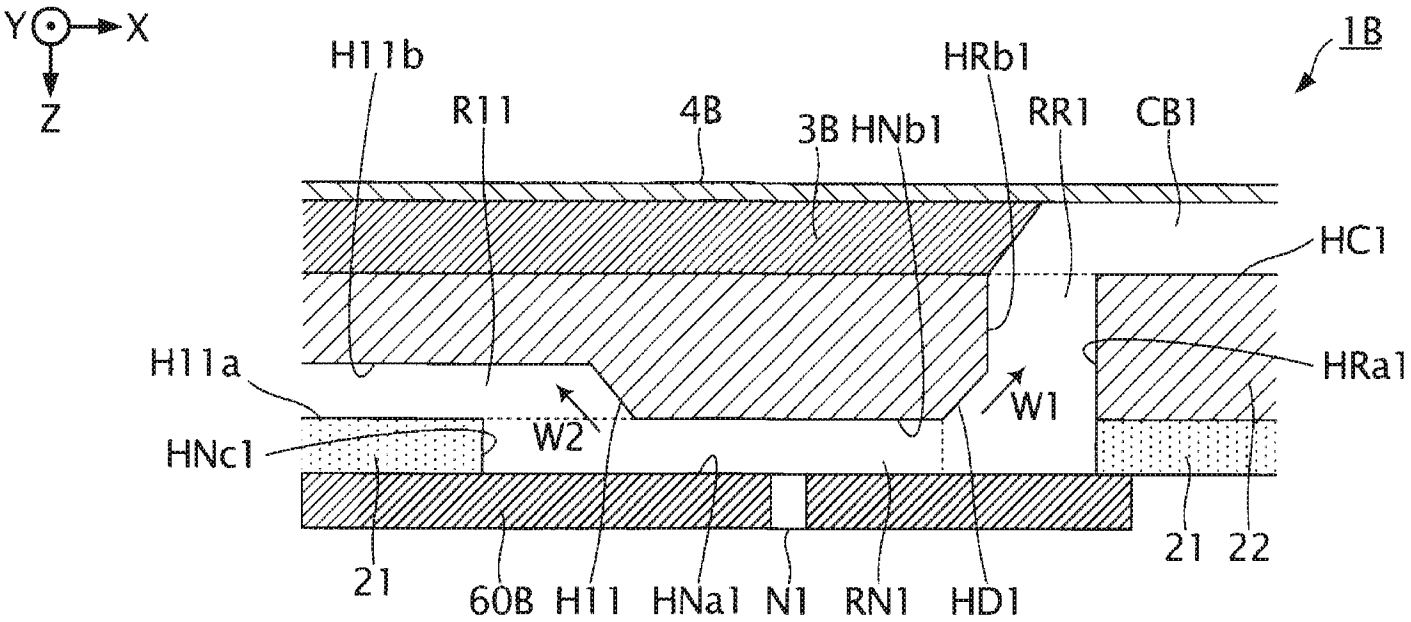
FIG. 14 is a sectional view illustrating an example of the configuration of the liquid ejecting head according to Modification 2.

FIG. 14 is a sectional view of the circulation channel RJ1 for illustrating the pressure chamber CB1, the communication channel RR1, the nozzle channel RN1, and the channel R11.

As illustrated in FIG. 14, the nozzle channel RN1 includes a wall surface HNa1, a wall surface HNb1, and a wall surface HNc1 as viewed in the Y-axis direction. Here, the wall surface HNa1 is a wall surface in which the nozzle N1 is formed among the wall surfaces forming the nozzle channel RN1 and which extends in the X-axis direction as viewed in the Y-axis direction. The wall surface HNb1 is a wall surface which is opposite to the wall surface HNa1 as viewed in the Y-axis direction and which extends in the X-axis direction. The wall surface HNc1 is a wall surface which forms an end of the nozzle channel RN1 on the −X side and which extends in the Z-axis direction as viewed in the Y-axis direction.

The channel R11 has a wall surface Hila, a wall surface H11*b*, and an inclined surface H11 as viewed in the Y-axis direction. Here, the wall surface Hila is a wall surface which is coupled to the wall surface HNc1 and which extends in the X-axis direction as viewed in the Y-axis direction. The wall surface H11*b* is a wall surface which is opposite to the wall surface Hila as viewed in the Y-axis direction and which extends in the X-axis direction. The inclined surface H11 is a wall surface which is provided between the wall surface HNb1 and the wall surface H11*b* and which extends in direction W2 as viewed in the Y-axis direction.

Note that, in the present modification, the inclined surface HD1 is provided between the wall surface HNb1 and the wall surface HRb1. In the present modification, the wall surface HRa1 is coupled to the wall surface HNa1.

Figure 15:
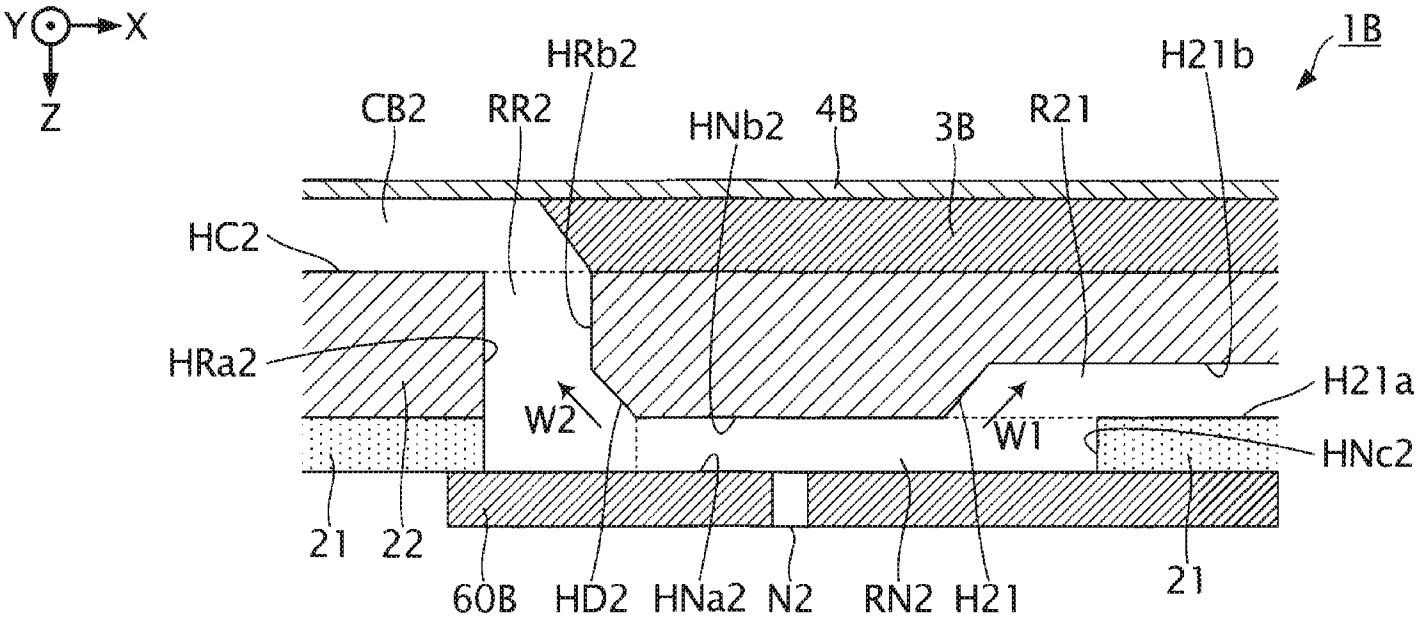
FIG. 15 is a sectional view illustrating an example of the configuration of the liquid ejecting head according to Modification 2.

FIG. 15 is a sectional view of the circulation channel RJ2 for illustrating the pressure chamber CB2, the communication channel RR2, the nozzle channel RN2, and the channel R21.

As illustrated in FIG. 15, the nozzle channel RN2 includes a wall surface HNa2, a wall surface HNb2, and a wall surface HNc2 as viewed in the Y-axis direction. Here, the wall surface HNa2 is a wall surface in which the nozzle N2 is formed among the wall surfaces forming the nozzle channel RN2 and which extends in the X-axis direction as viewed in the Y-axis direction. The wall surface HNb2 is a wall surface which is opposite to the wall surface HNa2 as viewed in the Y-axis direction and which extends in the X-axis direction. The wall surface HNc2 is a wall surface which forms an end of the nozzle channel RN2 on the +X side and which extends in the Z-axis direction as viewed in the Y-axis direction.

The channel R21 has a wall surface H21*a*, a wall surface H21*b*, and an inclined surface H21 as viewed in the Y-axis direction. Here, the wall surface H21*a* is a wall surface which is coupled to the wall surface HNc2 and which extends in the X-axis direction as viewed in the Y-axis direction. The wall surface H21*b* is a wall surface which is opposite to the wall surface H21*a* as viewed in the Y-axis direction and which extends in the X-axis direction. The inclined surface H21 is a wall surface which is provided between the wall surface HNb2 and the wall surface H21*b* and which extends in direction W1 as viewed in the Y-axis direction.

Note that, in the present modification, the inclined surface HD2 is provided between the wall surface HNb2 and the wall surface HRb2. In the present modification, the wall surface HRa2 is coupled to the wall surface HNa2.

Also in the present modification, since the inclined surface HD1 is provided between the wall surface HNb1 and the wall surface HRb1, it is possible to reduce the possibility of air bubbles remaining in the communication channel RR1 or the nozzle channel RN1 compared with an aspect in which the inclined surface HD1 is not provided between the wall surface HNb1 and the wall surface HRb1. Further, also in the present modification, since the inclined surface HD2 is provided between the wall surface HNb2 and the wall surface HRb2, it is possible to reduce the possibility of air bubbles remaining in the communication channel RR2 or the nozzle channel RN2 compared with an aspect in which the inclined surface HD2 is not provided between the wall surface HNb2 and the wall surface HRb2.

Modification 3

Although the liquid ejecting apparatus 100 of a serial type in which the endless belt 922 on which the liquid ejecting head 1, the liquid ejecting head 1A, or the liquid ejecting head 1B is mounted is reciprocated in the Y-axis direction is exemplified in the embodiment and Modifications 1 and 2 described above, the disclosure is not limited to such an aspect. The liquid ejecting apparatus may be a liquid ejecting apparatus of a line type in which a plurality of nozzles N are distributed over the entire width of the medium PP.

Figure 16:
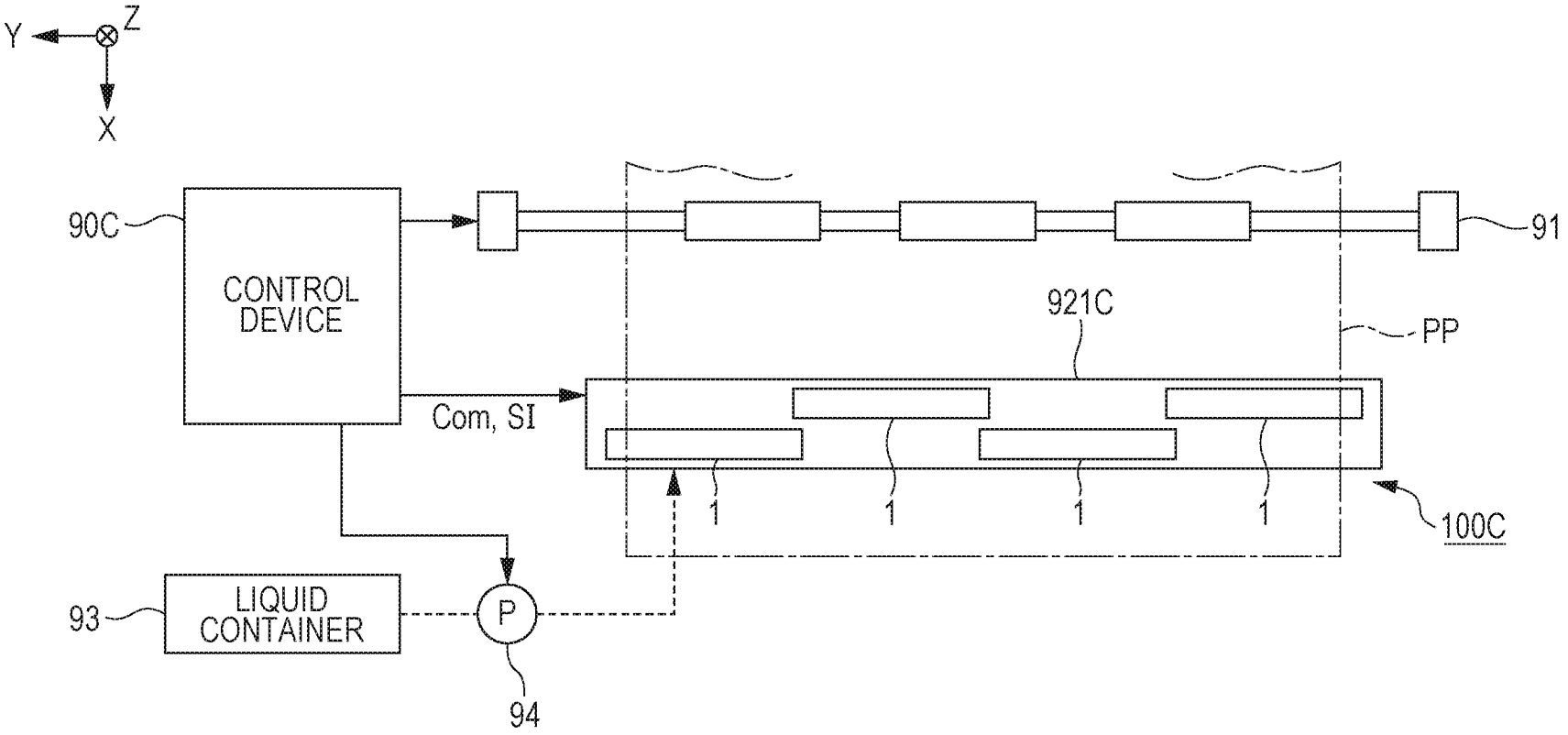
FIG. 16 is a configuration diagram illustrating an example of a liquid ejecting apparatus according to Modification 3.

FIG. 16 illustrates an example of a configuration of a liquid ejecting apparatus 100C according to the present modification. The liquid ejecting apparatus 100C differs from the liquid ejecting apparatus 100 according to the embodiment in terms of including a control device 90C instead of the control device 90, including a storage case 921C instead of the storage case 921, and not including the endless belt 922. The control device 90C differs from the control device 90 in terms of outputting no signal for controlling the endless belt 922. The storage case 921C is provided such that the plurality of liquid ejecting heads 1 having a longitudinal direction in the Y-axis direction are distributed over the entire width of the medium PP. Note that liquid ejecting heads 1A or liquid ejecting heads 1B may be mounted on the storage case 921C instead of the liquid ejecting heads 1.

Modification 4

Although the piezoelectric element PZ that converts electrical energy into kinetic energy is exemplified as the energy conversion element that applies pressure to the inside of the pressure chamber CB in the embodiment and Modifications 1 to 3 described above, the disclosure is not limited to such an aspect. As the energy conversion element that applies pressure to the inside of the pressure chamber CB, for example, a heating element that converts electrical energy into thermal energy, performs heating to generate air bubbles in the pressure chamber CB, and changes the pressure in the pressure chamber CB. The heating element may be, for example, an element in which a heating material generates heat in accordance with supply of the driving signal Com.

Modification 5

The liquid ejecting apparatus exemplified in the embodiment and Modifications 1 to 4 described above can be adopted for various apparatuses such as a facsimile apparatus and a copying machine in addition to equipment dedicated to printing. However, the liquid ejecting apparatus of the disclosure is not limited to being used for printing. For example, a liquid ejecting apparatus that ejects a solution of a color material is used as a manufacturing apparatus that forms a color filter of a liquid crystal display device. Further, a liquid ejecting apparatus that ejects a solution of a conductive material is used as a manufacturing apparatus that forms a wire and an electrode of a wiring substrate.

What is claimed is:

1. A liquid ejecting head comprising:

a pressure chamber substrate;

a nozzle substrate in which a nozzle for ejecting a liquid is provided; and a communication plate that is provided between the pressure chamber substrate and the nozzle substrate, wherein the pressure chamber substrate includes:

a first pressure chamber that extends in a first direction and applies pressure to the liquid;

a second pressure chamber that extends in the first direction and applies pressure to the liquid;

wherein the communication plate includes:

a nozzle channel that extends in the first direction and communicates with the nozzle for ejecting the liquid;

a first communication channel that extends in a second direction crossing the first direction and causes the first pressure chamber to communicate with the nozzle channel; and a second communication channel that extends in the second direction and causes the second pressure chamber to communicate with the nozzle channel, wherein wall surfaces of the nozzle channel include:

a first wall surface which extends in the first direction and in which the nozzle is provided and a second wall surface which extends in the first direction and is opposite to the first wall surface, wall surfaces of the first communication channel include:

a third wall surface which extends in the second direction, a fourth wall surface which extends in the second direction and is opposite to the third wall surface, and a fifth wall surface which extends in a third direction set between the first direction and the second direction is provided between the second wall surface and the fourth wall surface, the fifth wall surface being a straight inclined surface that couples the second and fourth wall surfaces, wherein a distance from the third wall surface to the nozzle in the first direction is longer than a distance from the other wall surfaces of the first communication channel and the nozzle in the first direction.

2. The liquid ejecting head according to claim 1, wherein an angle formed between a direction normal to the second wall surface and a direction normal to the fifth wall surface is larger than 20° and smaller than 80°.

3. The liquid ejecting head according to claim 1, wherein an angle formed between a direction normal to the fourth wall surface and a direction normal to the fifth wall surface is larger than 10° and smaller than 70°.

4. The liquid ejecting head according to claim 1, wherein the first wall surface is coupled to the third wall surface.

5. The liquid ejecting head according to claim 1, wherein a wall surface of the first pressure chamber includes a sixth wall surface which extends in the first direction, and the third wall surface is coupled to the sixth wall surface.

6. The liquid ejecting head according to claim 1, wherein wall surfaces of the second communication channel include a seventh wall surface which extends in the second direction, an eighth wall surface which extends in the second direction and is opposite to the seventh wall surface, and a ninth wall surface which extends in a fourth direction set between a direction opposite to the first direction and the second direction is provided between the second wall surface and the eighth wall surface, wherein a distance from the seventh wall surface to the nozzle in the first direction is longer than a distance from the other wall surfaces of the second communication channel and the nozzle in the first direction.

7. The liquid ejecting head according to claim 6, wherein an angle formed between the third direction and the second direction is substantially identical to an angle formed between the fourth direction and the second direction.

8. The liquid ejecting head according to claim 1, further comprising:

a supply channel which communicates with the first pressure chamber and along which the liquid is supplied to the first pressure chamber; and a discharge channel which communicates with the second pressure chamber and along which the liquid is discharged from the second pressure chamber.

9. The liquid ejecting head according to claim 1, further comprising:

a supply channel which communicates with the second pressure chamber and along which the liquid is supplied to the second pressure chamber; and a discharge channel which communicates with the first pressure chamber and along which the liquid is discharged from the first pressure chamber.

10. The liquid ejecting head according to claim 1, wherein the nozzle communicates with the nozzle channel at a substantially central position of the nozzle channel.

11. The liquid ejecting head according to claim 1, further comprising:

a first element that applies pressure to the liquid in the first pressure chamber in response to supply of a first driving signal; and a second element that applies pressure to the liquid in the second pressure chamber in response to supply of a second driving signal.

12. The liquid ejecting head according to claim 11, wherein a waveform of the first driving signal and a waveform of the second driving signal are substantially identical.

13. A liquid ejecting apparatus comprising:

a pressure chamber substrate;

a nozzle substrate in which a nozzle for ejecting a liquid is provided; and a communication plate that is provided between the pressure chamber substrate and the nozzle substrate, wherein the pressure chamber substrate includes:

a first pressure chamber that extends in a first direction and applies pressure to the liquid;

a second pressure chamber that extends in the first direction and applies pressure to the liquid;

wherein the communication plate includes:

a nozzle channel that extends in the first direction and communicates with the nozzle for ejecting the liquid;

a first communication channel that extends in a second direction crossing the first direction and causes the first pressure chamber to communicate with the nozzle channel; and a second communication channel that extends in the second direction and causes the second pressure chamber to communicate with the nozzle channel, wherein wall surfaces of the nozzle channel include:

a first wall surface which extends in the first direction and in which the nozzle is provided and a second wall surface which extends in the first direction and is opposite to the first wall surface, wall surfaces of the first communication channel include:

a third wall surface which extends in the second direction, a fourth wall surface which extends in the second direction and is opposite to the third wall surface, and a fifth wall surface which extends in a third direction set between the first direction and the second direction is provided between the second wall surface and the fourth wall surface, the fifth wall surface being a straight inclined surface that couples the second and fourth wall surfaces, wherein a distance from the third wall surface to the nozzle in the first direction is longer than a distance from the other wall surfaces of the first communication channel and the nozzle in the first direction.

* * * * *